US011856375B2

(12) United States Patent
Goldstein et al.

(10) Patent No.: US 11,856,375 B2
(45) Date of Patent: Dec. 26, 2023

(54) METHOD AND DEVICE FOR IN-EAR ECHO SUPPRESSION

(71) Applicant: Staton Techiya LLC, Lighthouse Point, FL (US)

(72) Inventors: Steven Wayne Goldstein, Delray Beach, FL (US); Marc Andre Boillot, Plantation, FL (US); John Usher, Devon (GB); Jason McIntosh, Sugar Hill, GA (US)

(73) Assignee: Staton Techiya LLC, Delray Beach, FL (US)

( * ) Notice: Subject to any disclaimer, the term of this patent is extended or adjusted under 35 U.S.C. 154(b) by 3 days.

(21) Appl. No.: 17/215,760

(22) Filed: Mar. 29, 2021

(65) Prior Publication Data

US 2021/0281945 A1 Sep. 9, 2021

Related U.S. Application Data

(63) Continuation-in-part of application No. 16/247,186, filed on Jan. 14, 2019, now Pat. No. 11,057,701, (Continued)

(51) Int. Cl.

| | |
|---|---|
| ***H04R 3/00*** | (2006.01) |
| ***H04R 25/02*** | (2006.01) |
| ***H04R 1/10*** | (2006.01) |

(52) U.S. Cl.

CPC ..... *H04R 3/002* (2013.01); *H04R 1/1016* (2013.01); *H04R 25/02* (2013.01)

(58) Field of Classification Search

CPC .... H04R 3/005; H04R 1/1083; H04R 1/1016; H04R 2410/05; H04R 25/505; (Continued)

(56) References Cited

U.S. PATENT DOCUMENTS 3,876,843 A 4/1975 Moen
4,054,749 A 10/1977 Suzuki et al.
(Continued)

FOREIGN PATENT DOCUMENTS

CN 203761556 8/2014
CN 203761556 U 8/2014
(Continued)

OTHER PUBLICATIONS

Olwal, A. and Feiner S. Interaction Techniques Using Prosodic Features of Speech and Audio Localization. Proceedings of IUI 2005 (International Conference on Intelligent User Interfaces), San Diego, CA, Jan. 9-12, 2005, p. 284-286.
(Continued)

*Primary Examiner* — Lun-See Lao
(74) *Attorney, Agent, or Firm* — Akerman LLP; Peter A. Chiabotti

(57) ABSTRACT

An earpiece (100) and acoustic management module (300) for in-ear canal echo suppression control suitable is provided. The earpiece can include an Ambient Sound Microphone (111) to capture ambient sound, an Ear Canal Receiver (125) to deliver audio content to an ear canal, an Ear Canal Microphone (123) configured to capture internal sound, and a processor (121) to generate a voice activity level (622) and suppress an echo of spoken voice in the electronic internal signal, and mix an electronic ambient signal with an electronic internal signal in a ratio dependent on the voice activity level and a background noise level to produce a mixed signal (323) that is delivered to the ear canal (131).

17 Claims, 10 Drawing Sheets

Related U.S. Application Data which is a continuation of application No. 13/956,767, filed on Aug. 1, 2013, now Pat. No. 10,182,289, which is a continuation of application No. 12/170,171, filed on Jul. 9, 2008, now Pat. No. 8,526,645, which is a continuation-in-part of application No. 12/115,349, filed on May 5, 2008, now Pat. No. 8,081,780.

(60) Provisional application No. 60/916,271, filed on May 4, 2007.

(58) Field of Classification Search

CPC ..... H04R 25/407; H04R 2225/43; H04R 2460/01; H04R 29/004; H04R 1/1091; H04R 2499/11; H04R 1/406; H04R 2460/13; H04R 25/00; H04R 25/02; H04R 25/70; H04R 3/00; H04R 2201/107; H04R 5/033; H04R 1/1041; H04R 2201/109; H04R 2410/01; H04R 2420/07; H04R 2460/05; H04R 25/405; H04R 3/002; H04R 3/04; H04R 25/453; G10L 15/22; G10L 21/0232; G10L 25/84; G10L 2015/223; G10L 2021/02165; G10L 21/038; G10L 21/0388; G10L 21/0208; G10L 21/0364; G10L 25/21; G10L 2021/02166; G10L 21/1081; G10K 11/17885; G10K 11/175; G10K 11/1754; G10K 11/17833; G10K 11/17861; G10K 11/17873; G10K 11/17875; G10K 2210/03

USPC ..... 381/74, 56–58, 66

See application file for complete search history.

(56) References Cited

U.S. PATENT DOCUMENTS 4,088,849 A 5/1978 Usami et al.
4,533,795 A 8/1985 Baumhauer, Jr. et al.
4,809,262 A 2/1989 Klose et al.
4,947,440 A 8/1990 Bateman et al.
5,002,151 A 3/1991 Oliveira et al.
5,131,032 A 7/1992 Esaki et al.
5,208,867 A 5/1993 Stites, III
5,251,263 A 10/1993 Andrea et al.
5,259,033 A 11/1993 Goodings et al.
5,267,321 A 11/1993 Langberg
5,276,740 A 1/1994 Inanaga et al.
5,317,273 A 5/1994 Hanson
5,327,506 A 7/1994 Stites
5,524,056 A 6/1996 Killion et al.
5,550,923 A 8/1996 Hotvet
5,577,511 A 11/1996 Killion
5,692,059 A 11/1997 Kruger
5,796,819 A 8/1998 Romesburg
5,903,868 A 5/1999 Yuen et al.
5,923,624 A 7/1999 Groeger
5,933,510 A 8/1999 Bryant
5,946,050 A 8/1999 Wolff
5,963,901 A 10/1999 Vanatalo et al.
5,999,828 A 12/1999 Sih et al.
6,005,525 A 12/1999 Kivela
6,021,207 A 2/2000 Puthuff et al.
6,021,325 A 2/2000 Hall
6,028,514 A 2/2000 Lemelson
6,056,698 A 5/2000 Iseberg
6,081,732 A 6/2000 Suvanen et al.
6,118,877 A 9/2000 Lindemann
6,118,878 A 9/2000 Jones
6,163,338 A 12/2000 Johnson et al.
6,163,508 A 12/2000 Kim et al.
6,169,912 B1 1/2001 Zuckerman
6,226,389 B1 5/2001 Lemelson et al.
6,298,323 B1 10/2001 Kaemmerer
6,304,648 B1 10/2001 Chang
6,359,993 B2 3/2002 Brimhall
6,381,572 B1 4/2002 Ishimitsu et al.
6,400,652 B1 6/2002 Goldberg et al.
6,408,272 B1 6/2002 White
6,415,034 B1 * 7/2002 Hietanen ..... G10K 11/17827 381/151
6,466,666 B1 10/2002 Eriksson
6,567,524 B1 5/2003 Svean et al.
6,570,985 B1 5/2003 Romesburg
6,606,598 B1 8/2003 Holthouse
6,631,196 B1 10/2003 Taenzer et al.
6,639,987 B2 10/2003 McIntosh
6,647,368 B2 11/2003 Nemirovski
RE38,351 E 12/2003 Iseberg et al.
6,661,901 B1 12/2003 Svean et al.
6,671,379 B2 12/2003 Nemirovski
6,728,385 B2 4/2004 Kvaloy et al.
6,748,238 B1 6/2004 Lau
6,754,359 B1 * 6/2004 Svean ..... H04R 1/1083 381/313
6,760,453 B1 7/2004 Banno
6,738,482 B1 9/2004 Jaber
6,804,638 B2 10/2004 Fiedler
6,804,643 B1 10/2004 Kiss
6,870,807 B1 3/2005 Chan et al.
7,003,097 B2 2/2006 Marchok et al.
7,003,099 B1 2/2006 Zhang
7,039,195 B1 5/2006 Svean
7,039,585 B2 5/2006 Wilmot
7,050,592 B1 5/2006 Iseberg
7,072,482 B2 7/2006 Van Doorn et al.
7,107,109 B1 9/2006 Nathan et al.
7,158,933 B2 1/2007 Balan
7,177,433 B2 2/2007 Sibbald
7,209,569 B2 4/2007 Boesen
7,236,580 B1 6/2007 Sarkar et al.
7,280,849 B1 10/2007 Bailey
7,349,353 B2 3/2008 Guduru et al.
7,403,608 B2 7/2008 Auvray et al.
7,430,299 B2 9/2008 Armstrong et al.
7,433,714 B2 10/2008 Howard et al.
7,444,353 B1 10/2008 Chen
7,450,730 B2 11/2008 Bertg et al.
7,464,029 B2 12/2008 Visser
7,477,756 B2 1/2009 Wickstrom et al.
7,502,484 B2 3/2009 Ngia et al.
7,512,245 B2 3/2009 Rasmussen
7,529,379 B2 5/2009 Zurek
7,562,020 B2 6/2009 Le et al.
7,574,917 B2 8/2009 Von Dach
7,756,285 B2 7/2010 Sjursen et al.
7,778,434 B2 8/2010 Juneau et al.
7,783,054 B2 8/2010 Ringlstetter et al.
7,801,318 B2 9/2010 Bartel
7,817,803 B2 10/2010 Goldstein
7,853,031 B2 12/2010 Hamacher
7,903,825 B1 3/2011 Melanson
7,903,826 B2 3/2011 Boersma
7,920,557 B2 4/2011 Moote
7,936,885 B2 5/2011 Frank
7,953,241 B2 5/2011 Jorgensen et al.
7,983,433 B2 7/2011 Nemirovski
7,983,907 B2 7/2011 Visser
7,986,802 B2 7/2011 Ziller
8,014,553 B2 9/2011 Radivojevic et al.
8,018,337 B2 9/2011 Jones
8,027,481 B2 9/2011 Beard
8,045,840 B2 10/2011 Murata
8,060,366 B1 11/2011 Maganti et al.
8,081,780 B2 12/2011 Goldstein et al.
8,086,093 B2 12/2011 Stuckman
8,140,325 B2 3/2012 Kanevsky
8,150,044 B2 4/2012 Goldstein
8,150,084 B2 4/2012 Jessen et al.
8,160,261 B2 4/2012 Schulein
8,160,273 B2 4/2012 Visser

(56) References Cited

U.S. PATENT DOCUMENTS 8,162,846 B2 4/2012 Epley
8,189,803 B2 5/2012 Bergeron
8,218,784 B2 7/2012 Schulein
8,254,591 B2 8/2012 Goldstein
8,270,629 B2 9/2012 Bothra
8,275,145 B2 9/2012 Buck et al.
8,351,634 B2 1/2013 Khenkin
8,380,521 B1 2/2013 Maganti et al.
8,401,178 B2 3/2013 Chen et al.
8,401,200 B2 3/2013 Tiscareno
8,477,955 B2 7/2013 Engle
8,493,204 B2 7/2013 Wong et al.
8,577,062 B2 11/2013 Goldstein
8,600,085 B2 12/2013 Chen et al.
8,611,560 B2 12/2013 Goldstein
8,625,818 B2 1/2014 Stultz
8,718,305 B2 5/2014 Usher
8,750,295 B2 6/2014 Liron
8,774,433 B2 7/2014 Goldstein
8,798,278 B2 8/2014 Isabelle
8,798,283 B2 8/2014 Gauger et al.
8,838,184 B2 9/2014 Burnett et al.
8,851,372 B2 10/2014 Zhou
8,855,343 B2 10/2014 Usher
8,917,894 B2 12/2014 Goldstein
8,983,081 B2 3/2015 Bayley
9,013,351 B2 4/2015 Park
9,037,458 B2 5/2015 Park et al.
9,053,697 B2 6/2015 Park
9,112,701 B2 8/2015 Sano
9,113,240 B2 8/2015 Ramakrishman
9,123,343 B2 9/2015 Kurki-Suonio
9,135,797 B2 9/2015 Couper et al.
9,191,740 B2 11/2015 McIntosh
9,196,247 B2 11/2015 Harada
9,270,244 B2 2/2016 Usher et al.
9,384,726 B2 7/2016 Le Faucheur
9,491,542 B2 11/2016 Usher
9,508,335 B2 11/2016 Benattar et al.
9,584,896 B1 2/2017 Kennedy
9,628,896 B2 4/2017 Ichimura
9,684,778 B2 6/2017 Tharappel
9,936,297 B2 4/2018 Dennis
9,953,626 B2 4/2018 Gauger, Jr. et al.
10,142,332 B2 11/2018 Ravindran
10,499,139 B2 12/2019 Ganeshkumar
10,709,339 B1 7/2020 Lusted
10,970,375 B2 4/2021 Manikantan
2001/0046304 A1 11/2001 Rast
2002/0076057 A1 6/2002 Voix
2002/0098878 A1 7/2002 Mooney
2002/0106091 A1 8/2002 Furst et al.
2002/0111798 A1 8/2002 Huang
2002/0118798 A1 8/2002 Langhart et al.
2002/0165719 A1 11/2002 Wang
2002/0193130 A1 12/2002 Yang
2003/0033152 A1 2/2003 Cameron
2003/0035551 A1 2/2003 Light et al.
2003/0112947 A1 6/2003 Cohen
2003/0130016 A1 7/2003 Matsuura
2003/0152359 A1 8/2003 Kim
2003/0161097 A1 8/2003 Le et al.
2003/0165246 A1 9/2003 Kvaloy et al.
2003/0165319 A1 9/2003 Barber
2003/0198359 A1 10/2003 Killion
2004/0042103 A1 3/2004 Mayer
2004/0047486 A1 3/2004 Van Doom et al.
2004/0086138 A1 5/2004 Kuth
2004/0109668 A1 6/2004 Stuckman
2004/0109579 A1 7/2004 Izuchi
2004/0125965 A1 7/2004 Alberth, Jr. et al.
2004/0133421 A1 7/2004 Burnett
2004/0137969 A1 7/2004 Nassimi
2004/0190737 A1 9/2004 Kuhnel et al.
2004/0196992 A1 10/2004 Ryan
2004/0202340 A1 10/2004 Armstrong
2004/0203351 A1 10/2004 Shearer et al.
2004/0264938 A1 12/2004 Felder
2005/0028212 A1 2/2005 Laronne
2005/0058313 A1* 3/2005 Victorian ..... H04R 25/554 381/328
2005/0068171 A1 3/2005 Kelliher
2005/0069161 A1 3/2005 Kaltenbach et al.
2005/0071158 A1 3/2005 Byford
2005/0078838 A1 4/2005 Simon
2005/0096899 A1 5/2005 Padhi et al.
2005/0102133 A1 5/2005 Rees
2005/0102142 A1 5/2005 Soufflet
2005/0123146 A1 6/2005 Voix et al.
2005/0168824 A1* 8/2005 Travers ..... G02B 27/0176 359/630
2005/0207605 A1 9/2005 Dehe
2005/0227674 A1 10/2005 Kopra
2005/0281422 A1 12/2005 Armstrong
2005/0281423 A1 12/2005 Armstrong
2005/0283369 A1 12/2005 Clauser et al.
2005/0288057 A1 12/2005 Lai et al.
2006/0062395 A1 3/2006 Klayman et al.
2006/0064037 A1 3/2006 Shalon et al.
2006/0067512 A1 3/2006 Boillot et al.
2006/0067551 A1 3/2006 Cartwright et al.
2006/0083387 A1 4/2006 Emoto
2006/0083388 A1 4/2006 Rothschild
2006/0083390 A1 4/2006 Kaderavek
2006/0083395 A1 4/2006 Allen et al.
2006/0092043 A1 5/2006 Lagassey
2006/0140425 A1 6/2006 Berg
2006/0153394 A1 7/2006 Beasley
2006/0167687 A1 7/2006 Kates
2006/0173563 A1 8/2006 Borovitski
2006/0182287 A1 8/2006 Schulein
2006/0188075 A1 8/2006 Peterson
2006/0188105 A1 8/2006 Baskerville et al.
2006/0195322 A1 8/2006 Broussard et al.
2006/0204014 A1 9/2006 Isenberg et al.
2006/0264176 A1 11/2006 Hong
2006/0287014 A1 12/2006 Matsuura
2007/0003090 A1 1/2007 Anderson
2007/0019817 A1 1/2007 Siltmann
2007/0021958 A1 1/2007 Visser et al.
2007/0036342 A1 2/2007 Boillot et al.
2007/0036377 A1 2/2007 Stirnemann
2007/0043563 A1 2/2007 Comerford et al.
2007/0014423 A1 4/2007 Darbut
2007/0086600 A1 4/2007 Boesen
2007/0092087 A1 4/2007 Bothra
2007/0100637 A1 5/2007 McCune
2007/0143820 A1 6/2007 Pawlowski
2007/0160243 A1 7/2007 Dijkstra
2007/0177741 A1 8/2007 Williamson
2007/0189544 A1 8/2007 Rosenberg
2007/0223717 A1 9/2007 Boersma
2007/0253569 A1 11/2007 Bose
2007/0255435 A1 11/2007 Cohen
2007/0291953 A1 12/2007 Ngia et al.
2008/0019539 A1 1/2008 Patel et al.
2008/0037801 A1 2/2008 Alves et al.
2008/0063228 A1 3/2008 Mejia
2008/0130908 A1 6/2008 Cohen
2008/0137873 A1 6/2008 Goldstein
2008/0145032 A1 6/2008 Lindroos
2008/0159547 A1 7/2008 Schuler
2008/0165988 A1 7/2008 Terlizzi et al.
2008/0205664 A1 8/2008 Kim et al.
2008/0221880 A1 9/2008 Cerra et al.
2009/0010444 A1 1/2009 Goldstein et al.
2009/0010456 A1 1/2009 Goldstein et al.
2009/0024234 A1 1/2009 Archibald
2009/0034748 A1 2/2009 Sibbald
2009/0076821 A1 3/2009 Brenner
2009/0085873 A1 4/2009 Betts
2009/0122996 A1 5/2009 Klein
2009/0286515 A1 5/2009 Othmer
2009/0147966 A1 6/2009 McIntosh et al.

(56) References Cited

U.S. PATENT DOCUMENTS

| | | | | |
|---|---|---|---|---|
| 2010/0061564 | A1 | 3/2010 | Clemow et al. | |
| 2010/0119077 | A1 | 5/2010 | Platz | |
| 2010/0296668 | A1 | 11/2010 | Lee et al. | |
| 2010/0316033 | A1 | 12/2010 | Atwal | |
| 2010/0328224 | A1 | 12/2010 | Kerr et al. | |
| 2011/0055256 | A1 | 3/2011 | Phillips | |
| 2011/0096939 | A1 | 4/2011 | Ichimura | |
| 2011/0103606 | A1 | 5/2011 | Silber | |
| 2011/0116643 | A1 | 5/2011 | Fiscareno | |
| 2011/0187640 | A1 | 8/2011 | Jacobsen et al. | |
| 2011/0264447 | A1 | 10/2011 | Visser et al. | |
| 2011/0293103 | A1 | 12/2011 | Park et al. | |
| 2012/0170412 | A1 | 7/2012 | Calhoun | |
| 2012/0184337 | A1 | 7/2012 | Burnett et al. | |
| 2013/0051543 | A1 | 2/2013 | McDysan et al. | |
| 2014/0023203 | A1 | 1/2014 | Rotschild | |
| 2014/0089672 | A1 | 3/2014 | Luna | |
| 2014/0122092 | A1 | 5/2014 | Goldstein | |
| 2014/0163976 | A1 | 6/2014 | Park | |
| 2014/0241553 | A1 | 8/2014 | Tiscareno et al. | |
| 2014/0370838 | A1 | 12/2014 | Kim | |
| 2015/0215701 | A1* | 7/2015 | Usher | H04R 1/1041 381/71.6 |
| 2015/0288823 | A1 | 10/2015 | Burnett et al. | |
| 2016/0058378 | A1 | 3/2016 | Wisby et al. | |
| 2016/0104452 | A1 | 4/2016 | Guan et al. | |
| 2017/0345406 | A1 | 11/2017 | Georgiou et al. | |
| 2019/0038224 | A1 | 2/2019 | Zhang | |
| 2019/0227767 | A1 | 7/2019 | Yang et al. | |
| 2021/0211801 | A1 | 7/2021 | Perez et al. | |

FOREIGN PATENT DOCUMENTS

| | | | |
|---|---|---|---|
| CN | 105554610 | | 1/2019 |
| CN | 105554610 | B | 1/2019 |
| CN | 105637892 | | 3/2020 |
| CN | 105637892 | A | 3/2020 |
| EP | 1385324 | | 1/2004 |
| EP | 1401240 | | 3/2004 |
| EP | 1519625 | A2 | 3/2005 |
| EP | 1640972 | | 3/2006 |
| EP | 1640972 | A1 | 3/2006 |
| EP | 2963647 | | 7/2019 |
| EP | 2963647 | B1 | 7/2019 |
| ES | 2273616 | | 12/2007 |
| ES | 2273616 | A1 | 12/2007 |
| JP | H0877468 | | 3/1996 |
| JP | H10162283 | | 6/1998 |
| JP | 3353701 | B2 | 12/2002 |
| JP | 2013501969 | | 1/2013 |
| JP | 2013501969 | A | 1/2013 |
| JP | 6389232 | | 9/2018 |
| JP | 6389232 | B2 | 9/2018 |
| KR | 20080111004 | | 12/2008 |
| KR | 20080111004 | A | 12/2008 |
| TW | M568011 | U | 10/2018 |
| WO | WO9326085 | A1 | 12/1993 |
| WO | 2004114722 | | 12/2004 |
| WO | 2006037156 | A1 | 4/2006 |
| WO | 2006054698 | | 5/2006 |
| WO | 2007092660 | | 8/2007 |
| WO | 2008050583 | | 5/2008 |
| WO | WO2008077981 | | 7/2008 |
| WO | WO2008077981 | A1 | 7/2008 |
| WO | 2009023784 | | 2/2009 |
| WO | 2012097150 | | 7/2012 |

OTHER PUBLICATIONS

Bernard Widrow, John R. Glover Jr., John M. McCool, John Kaunitz, Charles S. Williams, Robert H. Hearn, James R. Zeidler, Eugene Dong Jr, and Robert C. Goodlin, Adaptive Noise Cancelling: Principles and Applications, Proceedings of the IEEE, vol. 63, No. 12, Dec. 1975.

Mauro Dentino, John M. McCool, and Bernard Widrow, Adaptive Filtering in the Frequency Domain, Proceedings of the IEEE, vol. 66, No. 12, Dec. 1978.

*Samsung Electronics Co., Ltd., and Samsung Electronics, America, Inc.,* v. *Staton Techiya, LLC,* IPR2022-00282, Dec. 21, 2021.

*Samsung Electronics Co., Ltd., and Samsung Electronics, America, Inc.,* v. *Staton Techiya, LLC,* IPR2022-00242, Dec. 23, 2021.

*Samsung Electronics Co., Ltd., and Samsung Electronics, America, Inc.,* v. *Staton Techiya, LLC,* IPR2022-00243, Dec. 23, 2021.

*Samsung Electronics Co., Ltd., and Samsung Electronics, America, Inc.,* v. *Staton Techiya, LLC,* IPR2022-00234, Dec. 21, 2021.

*Samsung Electronics Co., Ltd., and Samsung Electronics, America, Inc.,* v. *Staton Techiya, LLC,* IPR2022-00253, Jan. 18, 2022.

*Samsung Electronics Co., Ltd., and Samsung Electronics, America, Inc.,* v. *Staton Techiya, LLC,* IPR2022-00324, Jan. 13, 2022.

*Samsung Electronics Co., Ltd., and Samsung Electronics, America, Inc.,* v. *Staton Techiya, LLC,* IPR2022-00281, Jan. 18, 2022.

*Samsung Electronics Co., Ltd., and Samsung Electronics, America, Inc.,* v. *Staton Techiya, LLC,* IPR2022-00302, Jan. 13, 2022.

*Samsung Electronics Co., Ltd., and Samsung Electronics, America, Inc.,* v. *Staton Techiya, LLC,* IPR2022-00369, Feb. 18, 2022.

*Samsung Electronics Co., Ltd., and Samsung Electronics, America, Inc.,* v. *Staton Techiya, LLC,* IPR2022-00388, Feb. 18, 2022.

*Samsung Electronics Co., Ltd., and Samsung Electronics, America, Inc.,* v. *Staton Techiya, LLC,* IPR2022-00410, Feb. 18, 2022.

*Samsung Electronics Co., Ltd., and Samsung Electronics, America, Inc.,* v. *Staton Techiya, LLC,* IPR2022-01078, Jun. 9, 2022.

*Samsung Electronics Co., Ltd., and Samsung Electronics, America, Inc.,* v. *Staton Techiya, LLC,* IPR2022-01099, Jun. 9, 2022.

*Samsung Electronics Co., Ltd., and Samsung Electronics, America, Inc.,* v. *Staton Techiya, LLC,* IPR2022-01106, Jun. 9, 2022.

*Samsung Electronics Co., Ltd., and Samsung Electronics, America, Inc.,* v. *Staton Techiya, LLC,* IPR2022-01098, Jun. 9, 2022.

90/019,169, Samsung Electronics Co., Ltd. and Samsung Electronics, America, Inc., Request for Ex Parte Reexamination of U.S. Pat. No. 11,244,666.

Oshana, DSP Software Development Techniques for Embedded and Real-Time Systems, Introduction, pp. xi-xvii (2006).

Mulgrew et al., Digital Signal Processing: Concepts and Applications, Introduction, pp. xxiii-xxvi (2nd ed. 2002).

Ronald M. Aarts, Roy Irwan, and Augustus J.E.. Janssen, Efficient Tracking of the Cross-Correlation Coefficient, IEEE Transactions on Speech and Audio Processing, vol. 10, No. 6, Sep. 2002.

Robert Oshana, DSP Software Development Techniques for Embedded and Real-Time Systems, Embedded Technology Series, Elsevier Inc., 2006, ISBN-10: 0-7506-7759-7.

90/015,146, Samsung Electronics Co., Ltd. and Samsung Electronics, America, Inc., Request for Ex Parte Reexamination of U.S. Pat. No. 10,979,836.

* cited by examiner

201

600

METHOD AND DEVICE FOR IN-EAR ECHO SUPPRESSION

CROSS REFERENCE TO RELATED APPLICATIONS

This application is a Continuation in Part of U.S. patent application Ser. No. 16/247,186, filed 14 Jan. 2019, which is a Continuation of U.S. patent application Ser. No. 13/956,767, filed on 1 Aug. 2018, now U.S. Pat. No. 10,182,289, which is a Continuation of U.S. patent application Ser. No. 12/170,171, filed on 9 Jul. 2008, now U.S. Pat. No. 8,526,645, which is a Continuation in Part of application Ser. No. 12/115,349 filed on May 5, 2008, now U.S. Pat. No. 8,081,780 which claims the priority benefit of Provisional Application No. 60/916,271 filed on May 4, 2007, the entire disclosure of all of which are incorporated herein by reference.

FIELD OF THE INVENTION

The present invention pertains to sound reproduction, sound recording, audio communications and hearing protection using earphone devices designed to provide variable acoustical isolation from ambient sounds while being able to audition both environmental and desired audio stimuli. Particularly, the present invention describes a method and device for suppressing echo in an ear-canal when capturing a user's voice when using an ambient sound microphone and an ear canal microphone.

BACKGROUND OF THE INVENTION

People use headsets or earpieces primarily for voice communications and music listening enjoyment. A headset or earpiece generally includes a microphone and a speaker for allowing the user to speak and listen. An ambient sound microphone mounted on the earpiece can capture ambient sounds in the environment; sounds that can include the user's voice. An ear canal microphone mounted internally on the earpiece can capture voice resonant within the ear canal; sounds generated when the user is speaking.

An earpiece that provides sufficient occlusion can utilize both the ambient sound microphone and the ear canal microphone to enhance the user's voice. An ear canal receiver mounted internal to the ear canal can loopback sound captured at the ambient sound microphone or the ear canal microphone to allow the user to listen to captured sound. If the earpiece is however not properly sealed within the ear canal, the ambient sounds can leak through into the ear canal and create an echo feedback condition with the ear canal microphone and ear canal receiver. In such cases, the feedback loop can generate an annoying "howling" sound that degrades the quality of the voice communication and listening experience.

SUMMARY OF THE INVENTION

Embodiments in accordance with the present invention provide a method and device for background noise control, ambient sound mixing and other audio control methods associated with an earphone. Note that although this application is filed as a continuation in part of U.S. patent application Ser. No. 16/247,186, the subject matter material can be found in U.S. patent application Ser. No. 12/170,171, filed on 9 Jul. 2008, now U.S. Pat. No. 8,526,645, application Ser. No. 12/115,349 filed on May 5, 2008, now U.S. Pat. No. 8,081,780, and Application No. 60/916,271 filed on May 4, 2007, all of which were incorporated by reference in U.S. patent application Ser. No. 16/247,186 and are incorporated by reference in their entirety herein.

In a first embodiment, a method for in-ear canal echo suppression control can include the steps of capturing an ambient acoustic signal from at least one Ambient Sound Microphone (ASM) to produce an electronic ambient signal, capturing in an ear canal an internal sound from at least one Ear Canal Microphone (ECM) to produce an electronic internal signal, measuring a background noise signal from the electronic ambient signal and the electronic internal signal, and capturing in the ear canal an internal sound from an Ear Canal Microphone (ECM) to produce an electronic internal signal. The electronic internal signal includes an echo of a spoken voice generated by a wearer of the earpiece. The echo in the electronic internal signal can be suppressed to produce a modified electronic internal signal containing primarily the spoken voice. A voice activity level can be generated for the spoken voice based on characteristics of the modified electronic internal signal and a level of the background noise signal. The electronic ambient signal and the electronic internal signal can then be mixed in a ratio dependent on the background noise signal to produce a mixed signal without echo that is delivered to the ear canal by way of the ECR.

An internal gain of the electronic internal signal can be increased as background noise levels increase, while an external gain of the electronic ambient signal can be decreased as the background noise levels increase. Similarly, the internal gain of the electronic internal signal can be increased as background noise levels decrease, while an external gain of the electronic ambient signal can be increased as the background noise levels decrease. The step of mixing can include filtering the electronic ambient signal and the electronic internal signal based on a characteristic of the background noise signal. The characteristic can be a level of the background noise level, a spectral profile, or an envelope fluctuation.

At low background noise levels and low voice activity levels, the electronic ambient signal can be amplified relative to the electronic internal signal in producing the mixed signal. At medium background noise levels and voice activity levels, low frequencies in the electronic ambient signal and high frequencies in the electronic internal signal can be attenuated. At high background noise levels and high voice activity levels, the electronic internal signal can be amplified relative to the electronic ambient signal in producing the mixed signal.

The method can include adapting a first set of filter coefficients of a Least Mean Squares (LMS) filter to model an inner ear-canal microphone transfer function (ECTF). The voice activity level of the modified electronic internal signal can be monitored, and an adaptation of the first set of filter coefficients for the modified electronic internal signal can be frozen if the voice activity level is above a predetermined threshold. The voice activity level can be determined by an energy level characteristic and a frequency response characteristic. A second set of filter coefficients for a replica of the LMS filter can be generated during the freezing and substituted back for the first set of filter coefficients when the voice activity level is below another predetermined threshold. The modified electronic internal signal can be transmitted to another voice communication device and looped back to the ear canal.

In a second embodiment, a method for in-ear canal echo suppression control can include capturing an ambient sound from at least one Ambient Sound Microphone (ASM) to produce an electronic ambient signal, delivering audio content to an ear canal by way of an Ear Canal Receiver (ECR) to produce an acoustic audio content, capturing in the ear canal by way of an Ear Canal Receiver (ECR) the acoustic audio content to produce an electronic internal signal, generating a voice activity level of a spoken voice in the presence of the acoustic audio content, suppressing an echo of the spoken voice in the electronic internal signal to produce a modified electronic internal signal, and controlling a mixing of the electronic ambient signal and the electronic internal signal based on the voice activity level. At least one voice operation of the earpiece can be controlled based on the voice activity level. The modified electronic internal signal can be transmitted to another voice communication device and looped back to the ear canal.

The method can include measuring a background noise signal from the electronic ambient signal and the electronic internal signal, and mixing the electronic ambient signal with the electronic internal signal in a ratio dependent on the background noise signal to produce a mixed signal that is delivered to the ear canal by way of the ECR. An acoustic attenuation level of the earpiece and an audio content level reproduced can be accounted for when adjusting the mixing based on a level of the audio content, the background noise level, and an acoustic attenuation level of the earpiece. The electronic ambient signal and the electronic internal signal can be filtered based on a characteristic of the background noise signal. The characteristic can be a level of the background noise level, a spectral profile, or an envelope fluctuation. The method can include applying a first gain (G1) to the electronic ambient signal, and applying a second gain (G2) to the electronic internal signal. The first gain and second gain can be a function of the background noise level and the voice activity level.

The method can include adapting a first set of filter coefficients of a Least Mean Squares (LMS) filter to model an inner ear-canal microphone transfer function (ECTF). The adaptation of the first set of filter coefficients can be frozen for the modified electronic internal signal if the voice activity level is above a predetermined threshold. A second set of filter coefficients for a replica of the LMS filter can be adapted during the freezing. The second set can be substituted back for the first set of filter coefficients when the voice activity level is below another predetermined threshold. The adaptation of the first set of filter coefficients can then be unfrozen.

In a third embodiment, an earpiece to provide in-ear canal echo suppression can include an Ambient Sound Microphone (ASM) configured to capture ambient sound and produce an electronic ambient signal, an Ear Canal Receiver (ECR) to deliver audio content to an ear canal to produce an acoustic audio content, an Ear Canal Microphone (ECM) configured to capture internal sound including spoken voice in an ear canal and produce an electronic internal signal, and a processor operatively coupled to the ASM, the ECM and the ECR. The audio content can be a phone call, a voice message, a music signal, or the spoken voice. The processor can be configured to suppress an echo of the spoken voice in the electronic internal signal to produce a modified electronic internal signal, generate a voice activity level for the spoken voice based on characteristics of the modified electronic internal signal and a level of the background noise signal, and mix the electronic ambient signal with the electronic internal signal in a ratio dependent on the background noise signal to produce a mixed signal that is delivered to the ear canal by way of the ECR. The processor can play the mixed signal back to the ECR for loopback listening. A transceiver operatively coupled to the processor can transmit the mixed signal to a second communication device.

A Least Mean Squares (LMS) echo suppressor can model an inner ear-canal microphone transfer function (ECTF) between the ASM and the ECM. A voice activity detector operatively coupled to the echo suppressor can adapt a first set of filter coefficients of the echo suppressor to model an inner ear-canal microphone transfer function (ECTF), and freeze an adaptation of the first set of filter coefficients for the modified electronic internal signal if the voice activity level is above a predetermined threshold. The voice activity detector during the freezing can also adapt a second set of filter coefficients for the echo suppressor, and substitute the second set of filter coefficients for the first set of filter coefficients when the voice activity level is below another predetermined threshold. Upon completing the substitution, the processor can unfreeze the adaptation of the first set of filter coefficients

DETAILED DESCRIPTION

Figure 1:
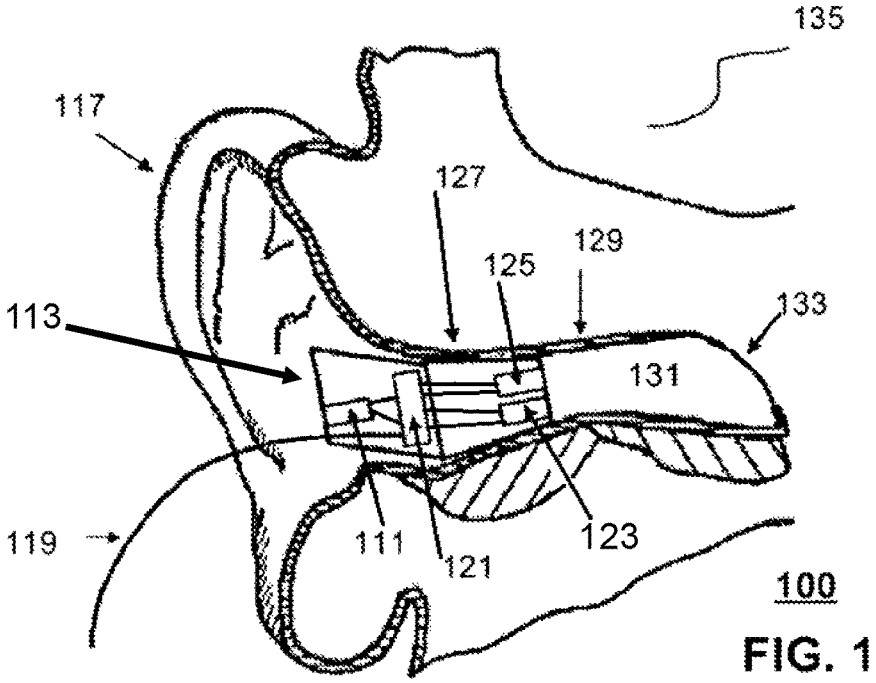
FIG. 1 is a pictorial diagram of an earpiece in accordance with an exemplary embodiment.

The following description of at least one exemplary embodiment is merely illustrative in nature and is in no way intended to limit the invention, its application, or uses.

Processes, techniques, apparatus, and materials as known by one of ordinary skill in the relevant art may not be discussed in detail but are intended to be part of the enabling description where appropriate, for example the fabrication and use of transducers.

In all of the examples illustrated and discussed herein, any specific values, for example the sound pressure level change, should be interpreted to be illustrative only and non-limiting. Thus, other examples of the exemplary embodiments could have different values.

Note that similar reference numerals and letters refer to similar items in the following figures, and thus once an item is defined in one figure, it may not be discussed for following figures.

Note that herein when referring to correcting or preventing an error or damage (e.g., hearing damage), a reduction of the damage or error and/or a correction of the damage or error are intended.

Various embodiments herein provide a method and device for automatically mixing audio signals produced by a pair of microphone signals that monitor a first ambient sound field and a second ear canal sound field, to create a third new mixed signal. An Ambient Sound Microphone (ASM) and an Ear Canal Microphone (ECM) can be housed in an earpiece that forms a seal in the ear of a user. The third mixed signal can be auditioned by the user with an Ear Canal Receiver (ECR) mounted in the earpiece, which creates a sound pressure in the occluded ear canal of the user. A voice activity detector can determine when the user is speaking and control an echo suppressor to suppress associated feedback in the ECR.

When the user engages in a voice communication, the echo suppressor can suppress feedback of the spoken voice from the ECR. The echo suppressor can contain two sets of filter coefficients; a first set that adapts when voice is not present and becomes fixed when voice is present, and a second set that adapts when the first set is fixed. The voice activity detector can discriminate between audible content, such as music, that the user is listening to, and spoken voice generated by the user when engaged in voice communication. The third mixed signal contains primarily the spoken voice captured at the ASM and ECM without echo, and can be transmitted to a remote voice communications system, such as a mobile phone, personal media player, recording device, walkie-talkie radio, etc. Before the ASM and ECM signals are mixed, they can be echo suppressed and subjected to different filters and at optional additional gains. This permits a single earpiece to provide full-duplex voice communication with proper or improper acoustic sealing.

The characteristic responses of the ASM and ECM filter can differ based on characteristics of the background noise and the voice activity level. In some exemplary embodiments, the filter response can depend on the measured Background Noise Level (BNL). A gain of a filtered ASM and a filtered ECM signal can also depend on the BNL. The (BNL) can be calculated using either or both the conditioned ASM and/or ECM signal(s). The BNL can be a slow time weighted average of the level of the ASM and/or ECM signals, and can be weighted using a frequency-weighting system, e.g. to give an A-weighted SPL level (i.e. the high and low frequencies are attenuated before the level of the microphone signals are calculated).

At least one exemplary embodiment of the invention is directed to an earpiece for voice operated control. Reference is made to FIG. 1 in which an earpiece device, generally indicated as earpiece 100, is constructed and operates in accordance with at least one exemplary embodiment of the invention. As illustrated, earpiece 100 depicts an electro-acoustical assembly 113 for an in-the-ear acoustic assembly, as it would typically be placed in the ear canal 131 of a user 135. The earpiece 100 can be an in the ear earpiece, behind the ear earpiece, receiver in the ear, open-fit device, or any other suitable earpiece type. The earpiece 100 can be partially or fully occluded in the ear canal, and is suitable for use with users having healthy or abnormal auditory functioning.

Earpiece 100 includes an Ambient Sound Microphone (ASM) 111 to capture ambient sound, an Ear Canal Receiver (ECR) 125 to deliver audio to an ear canal 131, and an Ear Canal Microphone (ECM) 123 to assess a sound exposure level within the ear canal 131. The earpiece 100 can partially or fully occlude the ear canal 131 to provide various degrees of acoustic isolation. The assembly is designed to be inserted into the user's ear canal 131, and to form an acoustic seal with the walls 129 of the ear canal at a location 127 between the entrance 117 to the ear canal and the tympanic membrane (or ear drum) 133. Such a seal is typically achieved by means of a soft and compliant housing of assembly 113. Such a seal creates a closed cavity 131 of approximately 5 cc between the in-ear assembly 113 and the tympanic membrane 133. As a result of this seal, the ECR (speaker) 125 is able to generate a full range frequency response when reproducing sounds for the user. This seal also serves to significantly reduce the sound pressure level at the user's eardrum resulting from the sound field at the entrance to the ear canal 131. This seal is also a basis for a sound isolating performance of the electro-acoustic assembly.

Located adjacent to the ECR 125, is the ECM 123, which is acoustically coupled to the (closed or partially closed) ear canal cavity 131. One of its functions is that of measuring the sound pressure level in the ear canal cavity 131 as a part of testing the hearing acuity of the user as well as confirming the integrity of the acoustic seal and the working condition of the earpiece 100. In one arrangement, the ASM 111 can be housed in the assembly 113 to monitor sound pressure at the entrance to the occluded or partially occluded ear canal. All transducers shown can receive or transmit audio signals to a processor 121 that undertakes audio signal processing and provides a transceiver for audio via the wired or wireless communication path 119.

The earpiece 100 can actively monitor a sound pressure level both inside and outside an ear canal and enhance spatial and timbral sound quality while maintaining supervision to ensure safe sound reproduction levels. The earpiece 100 in various embodiments can conduct listening tests, filter sounds in the environment, monitor warning sounds in the environment, present notification based on identified warning sounds, maintain constant audio content to ambient sound levels, and filter sound in accordance with a Personalized Hearing Level (PHL).

The earpiece 100 can measure ambient sounds in the environment received at the ASM 111. Ambient sounds correspond to sounds within the environment such as the sound of traffic noise, street noise, conversation babble, or any other acoustic sound. Ambient sounds can also correspond to industrial sounds present in an industrial setting, such as, factory noise, lifting vehicles, automobiles, and robots to name a few.

The earpiece 100 can generate an Ear Canal Transfer Function (ECTF) to model the ear canal 131 using ECR 125 and ECM 123, as well as an Outer Ear Canal Transfer function (OETF) using ASM 111. For instance, the ECR 125 can deliver an impulse within the ear canal and generate the ECTF via cross correlation of the impulse with the impulse response of the ear canal. The earpiece 100 can also determine a sealing profile with the user's ear to compensate for any leakage. It also includes a Sound Pressure Level Dosimeter to estimate sound exposure and recovery times. This permits the earpiece 100 to safely administer and monitor sound exposure to the ear.

Figure 2:
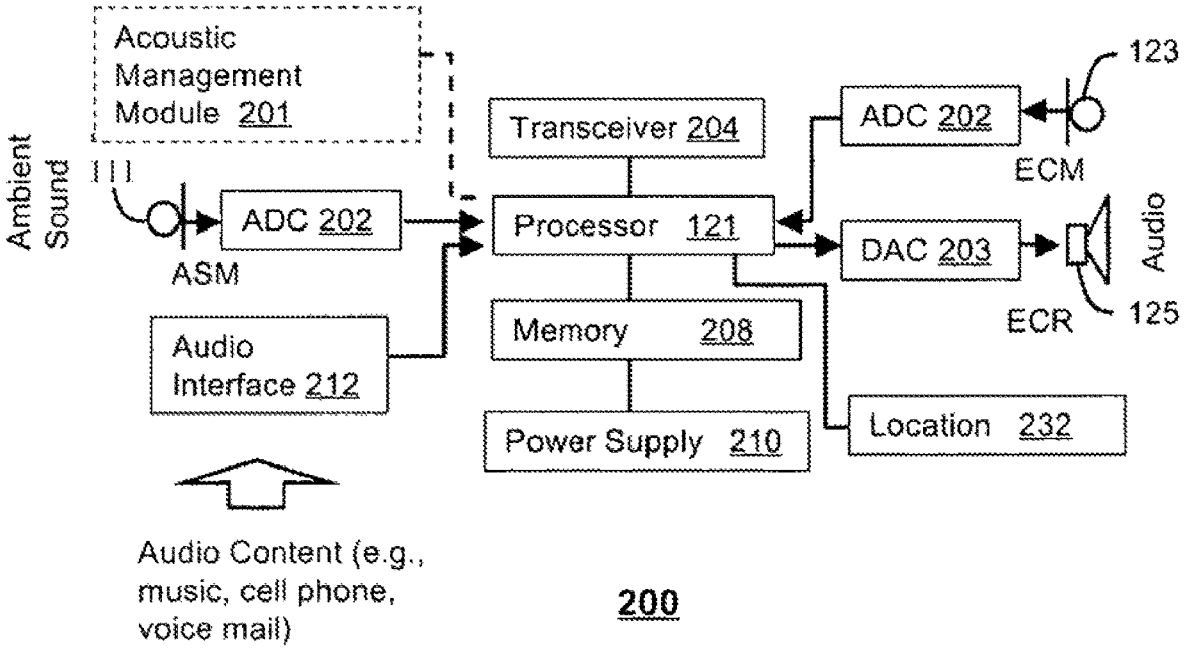
FIG. 2 is a block diagram of the earpiece in accordance with an exemplary embodiment.

Referring to FIG. 2, a block diagram 200 of the earpiece 100 in accordance with an exemplary embodiment is shown. As illustrated, the earpiece 100 can include the processor 121 operatively coupled to the ASM 111, ECR 125, and ECM 123 via one or more Analog to Digital Converters (ADC) 202 and Digital to Analog Converters (DAC) 203. The processor 121 can utilize computing technologies such as a microprocessor, Application Specific Integrated Chip (ASIC), and/or digital signal processor (DSP) with associated storage memory 208 such as Flash, ROM, RAM, SRAM, DRAM or other like technologies for controlling operations of the earpiece device 100. The processor 121 can also include a clock to record a time stamp.

As illustrated, the earpiece 100 can include an acoustic management module 201 to mix sounds captured at the ASM 111 and ECM 123 to produce a mixed sound. The processor 121 can then provide the mixed signal to one or more subsystems, such as a voice recognition system, a voice dictation system, a voice recorder, or any other voice related processor or communication device. The acoustic management module 201 can be a hardware component implemented by discrete or analog electronic components or a software component. In one arrangement, the functionality of the acoustic management module 201 can be provided by way of software, such as program code, assembly language, or machine language.

The memory 208 can also store program instructions for execution on the processor 121 as well as captured audio processing data and filter coefficient data. The memory 208 can be off-chip and external to the processor 121 and include a data buffer to temporarily capture the ambient sound and the internal sound, and a storage memory to save from the data buffer the recent portion of the history in a compressed format responsive to a directive by the processor 121. The data buffer can be a circular buffer that temporarily stores audio sound at a current time point to a previous time point. It should also be noted that the data buffer can in one configuration reside on the processor 121 to provide high speed data access. The storage memory can be non-volatile memory such as SRAM to store captured or compressed audio data.

The earpiece 100 can include an audio interface 212 operatively coupled to the processor 121 and acoustic management module 201 to receive audio content, for example from a media player, cell phone, or any other communication device, and deliver the audio content to the processor 121. The processor 121 responsive to detecting spoken voice from the acoustic management module 201 can adjust the audio content delivered to the ear canal. For instance, the processor 121 (or acoustic management module 201) can lower a volume of the audio content responsive to detecting a spoken voice. The processor 121 by way of the ECM 123 can also actively monitor the sound exposure level inside the ear canal and adjust the audio to within a safe and subjectively optimized listening level range based on voice operating decisions made by the acoustic management module 201.

The earpiece 100 can further include a transceiver 204 that can support singly or in combination any number of wireless access technologies including without limitation Bluetooth™, Wireless Fidelity (WiFi), Worldwide Interoperability for Microwave Access (WiMAX), and/or other short or long range communication protocols. The transceiver 204 can also provide support for dynamic downloading over-the-air to the earpiece 100. It should be noted also that next generation access technologies can also be applied to the present disclosure.

The location receiver 232 can utilize common technology such as a common GPS (Global Positioning System) receiver that can intercept satellite signals and therefrom determine a location fix of the earpiece 100.

The power supply 210 can utilize common power management technologies such as replaceable batteries, supply regulation technologies, and charging system technologies for supplying energy to the components of the earpiece 100 and to facilitate portable applications. A motor (not shown) can be a single supply motor driver coupled to the power supply 210 to improve sensory input via haptic vibration. As an example, the processor 121 can direct the motor to vibrate responsive to an action, such as a detection of a warning sound or an incoming voice call.

The earpiece 100 can further represent a single operational device or a family of devices configured in a master-slave arrangement, for example, a mobile device and an earpiece. In the latter embodiment, the components of the earpiece 100 can be reused in different form factors for the master and slave devices.

Figure 3:
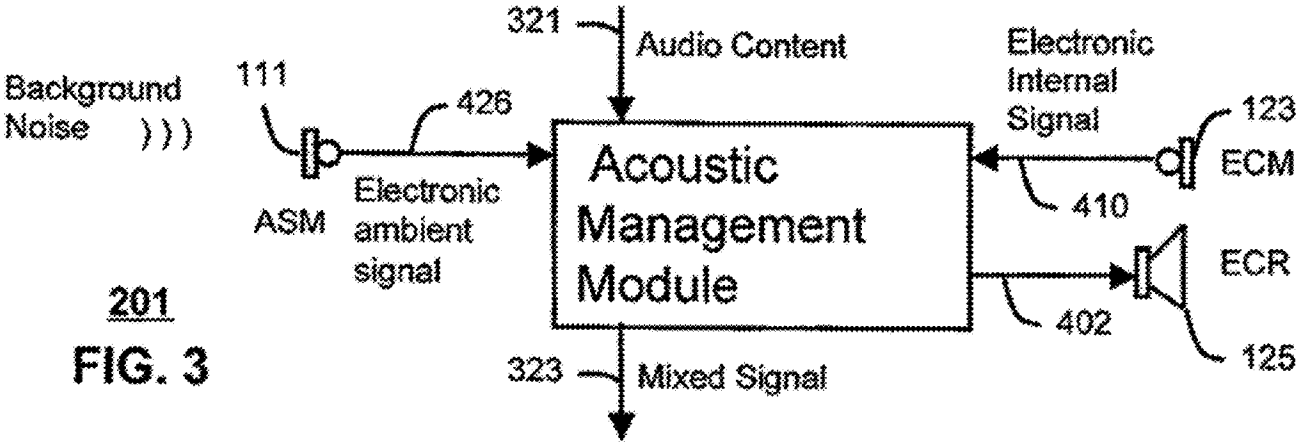
FIG. 3 is a block diagram for an acoustic management module in accordance with an exemplary embodiment.

FIG. 3 is a block diagram of the acoustic management module 201 in accordance with an exemplary embodiment. Briefly, the Acoustic management module 201 facilitates monitoring, recording and transmission of user-generated voice (speech) to a voice communication system. User-generated sound is detected with the ASM 111 that monitors a sound field near the entrance to a user's ear, and with the ECM 123 that monitors a sound field in the user's occluded ear canal. A new mixed signal 323 is created by filtering and mixing the ASM and ECM microphone signals. The filtering and mixing process is automatically controlled depending on the background noise level of the ambient sound field to enhance intelligibility of the new mixed signal 323. For instance, when the background noise level is high, the acoustic management module 201 automatically increases the level of the ECM 123 signal relative to the level of the ASM 111 to create the new signal mixed 323. When the background noise level is low, the acoustic management module 201 automatically decreases the level of the ECM 123 signal relative to the level of the ASM 111 to create the new signal mixed 323

As illustrated, the ASM 111 is configured to capture ambient sound and produce an electronic ambient signal 426, the ECR 125 is configured to pass, process, or play acoustic audio content 402 (e.g., audio content 321, mixed signal 323) to the ear canal, and the ECM 123 is configured to capture internal sound in the ear canal and produce an electronic internal signal 410. The acoustic management module 201 is configured to measure a background noise signal from the electronic ambient signal 426 or the electronic internal signal 410, and mix the electronic ambient signal 426 with the electronic internal signal 410 in a ratio dependent on the background noise signal to produce the mixed signal 323. The acoustic management module 201 filters the electronic ambient signal 426 and the electronic internal 410 signal based on a characteristic of the background noise signal using filter coefficients stored in memory or filter coefficients generated algorithmically.

In practice, the acoustic management module 201 mixes sounds captured at the ASM 111 and the ECM 123 to produce the mixed signal 323 based on characteristics of the background noise in the environment and a voice activity level. The characteristics can be a background noise level, a spectral profile, or an envelope fluctuation. The acoustic management module 201 manages echo feedback conditions affecting the voice activity level when the ASM 111, the ECM 123, and the ECR 125 are used together in a single earpiece for full-duplex communication, when the user is speaking to generate spoken voice (captured by the ASM 111 and ECM 123) and simultaneously listening to audio content (delivered by ECR 125).

In noisy ambient environments, the voice captured at the ASM 111 includes the background noise from the environment, whereas, the internal voice created in the ear canal 131 captured by the ECM 123 has less noise artifacts, since the noise is blocked due to the occlusion of the earpiece 100 in the ear. It should be noted that the background noise can enter the ear canal if the earpiece 100 is not completely sealed. In this case, when speaking, the user's voice can leak through and cause an echo feedback condition that the acoustic management module 201 mitigates.

Figure 4:
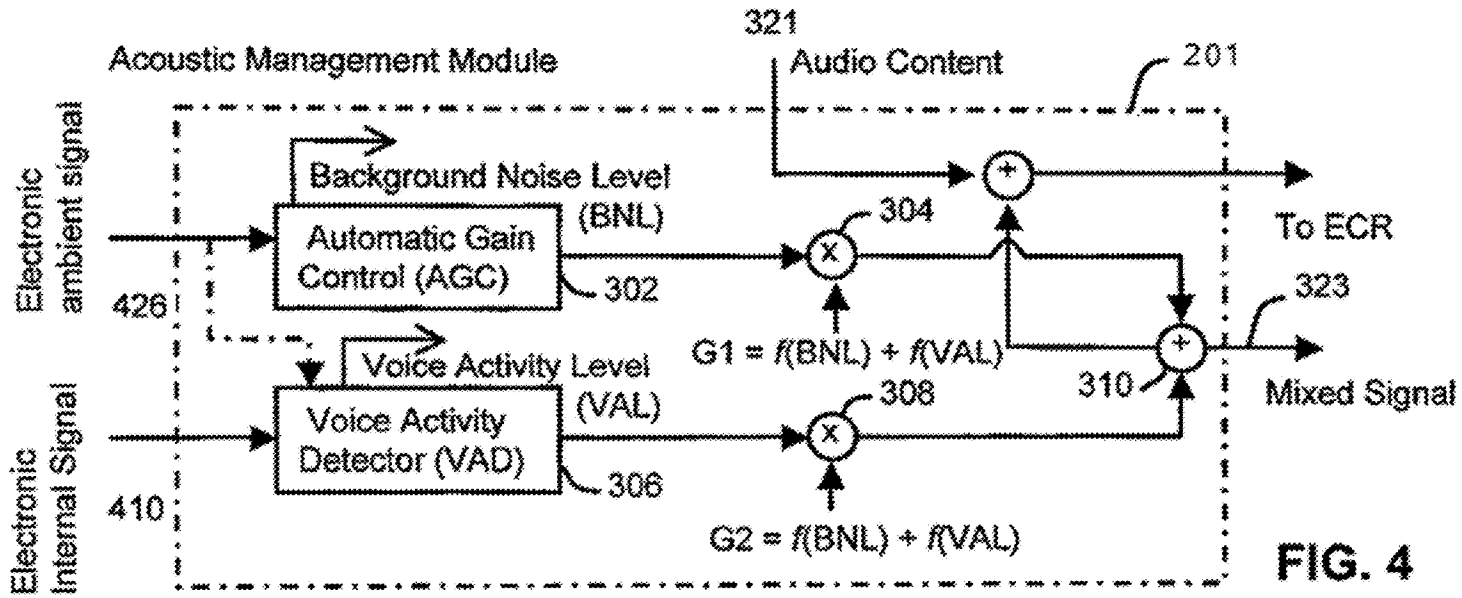
FIG. 4 is a schematic for the acoustic management module of FIG. 3 illustrating a mixing of an external microphone signal with an internal microphone signal as a function of a background noise level and voice activity level in accordance with an exemplary embodiment.

FIG. 4 is a schematic of the acoustic management module 201 illustrating a mixing of the electronic ambient signal 426 with the electronic internal signal 410 as a function of a background noise level (BNL) and a voice activity level (VAL) in accordance with an exemplary embodiment. As illustrated, the acoustic management module 201 includes an Automatic Gain Control (AGC) 302 to measure background noise characteristics. The acoustic management module 201 also includes a Voice Activity Detector (VAD) 306. The VAD 306 can analyze either or both the electronic ambient signal 426 and the electronic internal signal 410 to estimate the VAL. As an example, the VAL can be a numeric range such as 0 to 10 indicating a degree of voicing. For instance, a voiced signal can be predominately periodic due to the periodic vibrations of the vocal cords. A highly voiced signal (e.g., vowel) can be associated with a high level, and a non-voiced signal (e.g., fricative, plosive, consonant) can be associated with a lower level.

The acoustic management module 201 includes a first gain (G1) 304 applied to the AGC processed electronic ambient signal 426. A second gain (G2) 308 is applied to the VAD processed electronic internal signal 410. The acoustic management module 201 applies the first gain (G1) 304 and the second gain (G2) 308 as a function of the background noise level and the voice activity level to produce the mixed signal 323, where $$G1=f(\text{BNL})+f(\text{VAL}) \text{ and } G2=f(\text{BNL})+f(\text{VAL})$$

As illustrated, the mixed signal 323 is the sum 310 of the G1 scaled electronic ambient signal and the G2 scaled electronic internal signal. The mixed signal 323 can then be transmitted to a second communication device (e.g. second cell phone, voice recorder, etc.) to receive the enhanced voice signal. The acoustic management module 201 can also play the mixed signal 323 back to the ECR for loopback listening. The loopback allows the user to hear himself or herself when speaking, as though the earpiece 100 and associated occlusion effect were absent. The loopback can also be mixed with the audio content 321 based on the background noise level, the VAL, and audio content level. The acoustic management module 201 can also account for an acoustic attenuation level of the earpiece, and account for the audio content level reproduced by the ECR when measuring background noise characteristics. Echo conditions created as a result of the loopback can be mitigated to ensure that the voice activity level is accurate.

Figure 5:
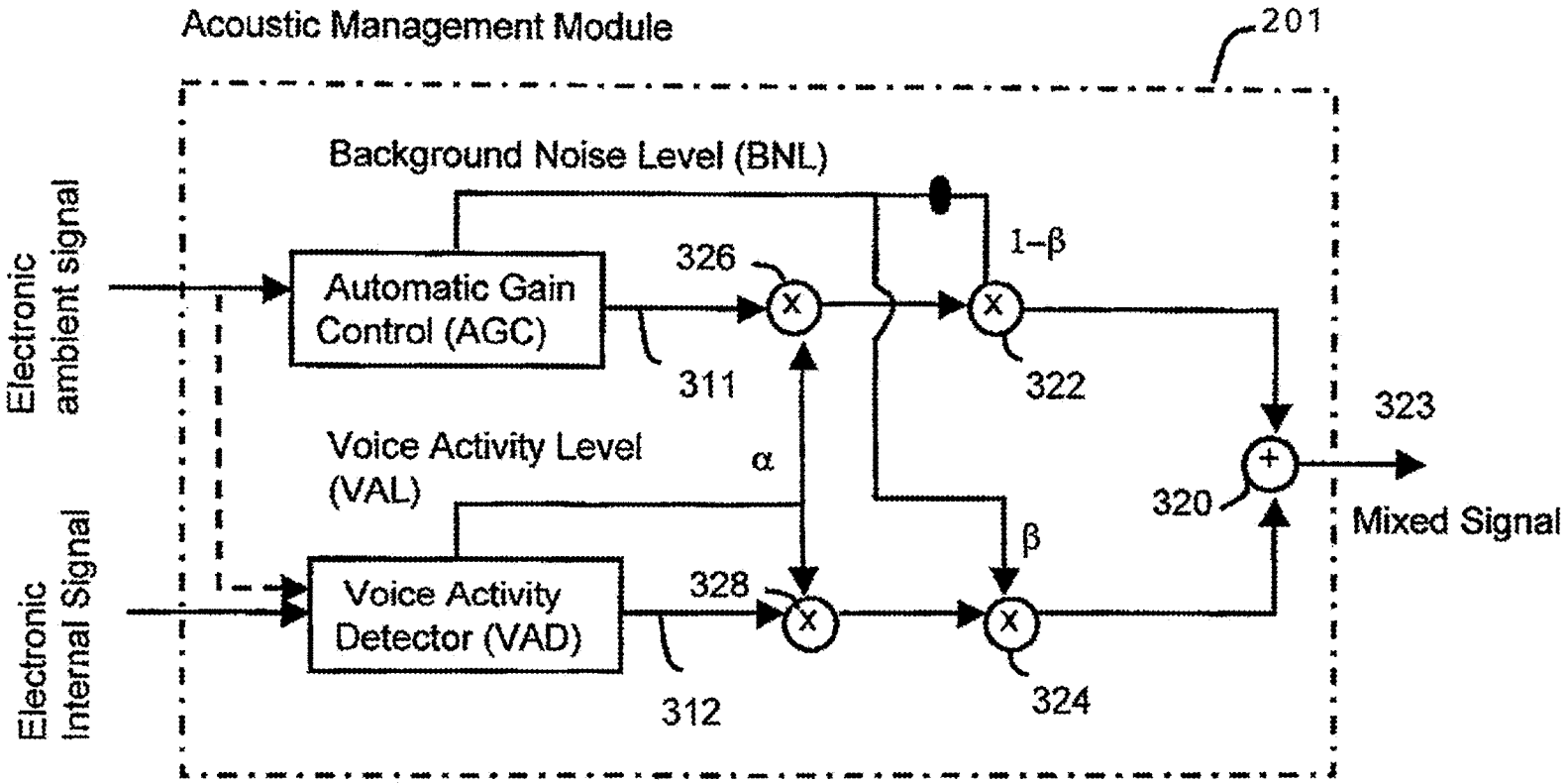
FIG. 5 is a more detailed schematic of the acoustic management module of FIG. 3 illustrating a mixing of an external microphone signal with an internal microphone signal based on a background noise level and voice activity level in accordance with an exemplary embodiment.

FIG. 5 is a more detailed schematic of the acoustic management module 201 illustrating a mixing of an external microphone signal with an internal microphone signal based on a background noise level and voice activity level in accordance with an exemplary embodiment. In particular, the gain blocks for G1 and G2 of FIG. 4 are a function of the BNL and the VAL and are shown in greater detail. As illustrated, the AGC produces a BNL that can be used to set a first gain 322 for the processed electronic ambient signal 311 and a second gain 324 for the processed electronic internal signal 312. For instance, when the BNL is low (<70 dBA), gain 322 is set higher relative to gain 324 so as to amplify the electronic ambient signal 311 in greater proportion than the electronic internal signal 312. When the BNL is high (>85 dBA), gain 322 is set lower relative to gain 324 so as to attenuate the electronic ambient signal 311 in greater proportion than the electronic internal signal 312. The mixing can be performed in accordance with the relation:

$$\text{Mixed signal}=(1-\beta)*\text{electronic ambient signal}+(\beta)*\text{electronic internal signal}$$

where $(1-\beta)$ is an external gain, $(\beta)$ is an internal gain, and the mixing is performed with $0<\beta<1$.

As illustrated, the VAD produces a VAL that can be used to set a third gain 326 for the processed electronic ambient signal 311 and a fourth gain 328 for the processed electronic internal signal 312. For instance, when the VAL is low (e.g., 0-3), gain 326 and gain 328 are set low so as to attenuate the electronic ambient signal 311 and the electronic internal signal 312 when spoken voice is not detected. When the VAL is high (e.g., 7-10), gain 326 and gain 328 are set high so as to amplify the electronic ambient signal 311 and the electronic internal signal 312 when spoken voice is detected.

The gain scaled processed electronic ambient signal 311 and the gain scaled processed electronic internal signal 312 are then summed at adder 320 to produce the mixed signal 323. The mixed signal 323, as indicated previously, can be transmitted to another communication device, or as loopback to allow the user to hear his or her self.

Figure 6:
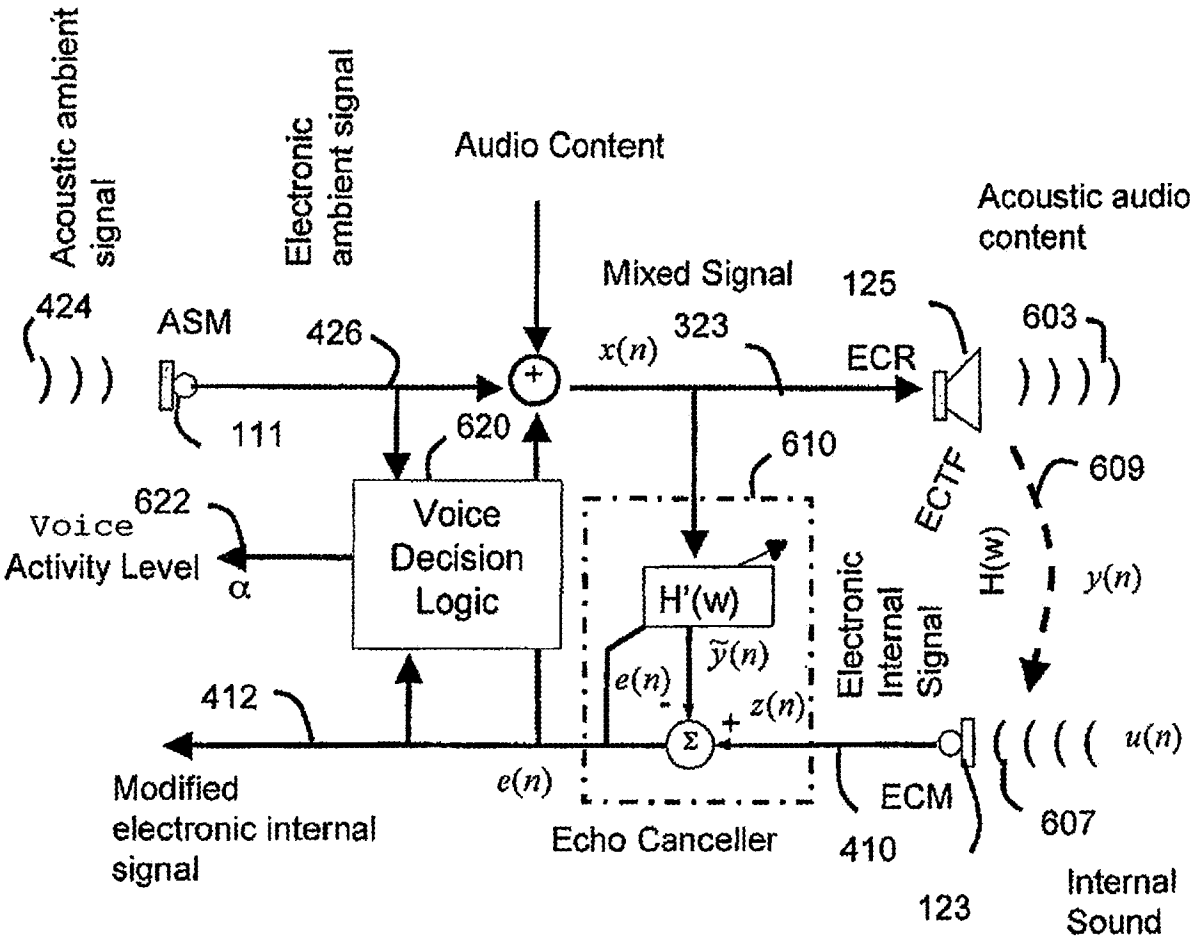
FIG. 6 is a block diagram of a system for in-ear canal echo suppression in accordance with an exemplary embodiment.

FIG. 6 is an exemplary schematic of an operational unit 600 of the acoustic management module for in-ear canal echo suppression in accordance with an embodiment. The operational unit 600 may contain more or less than the number of components shown in the schematic. The operational unit 600 can include an echo suppressor 610 and a voice decision logic 620.

The echo suppressor 610 can be a Least Mean Squares (LMS) or Normalized Least Mean Squares (NLMS) adaptive filter that models an ear canal transfer function (ECTF) between the ECR 125 and the ECM 123. The echo suppressor 610 generates the modified electronic signal, e(n), which is provided as an input to the voice decision logic 620; e(n) is also termed the error signal e(n) of the echo suppressor 610. Briefly, the error signal e(n) 412 is used to update the filter H(w) to model the ECTF of the echo path. The error signal e(n) 412 closely approximates the user's spoken voice signal u(n) 607 when the echo suppressor 610 accurately models the ECTF.

In the configuration shown the echo suppressor 610 minimizes the error between the filtered signal, $\gamma(n)$, and the electronic internal signal, z(n), in an effort to obtain a transfer function H' which is a best approximation to the H(w) (i.e., ECTF). H(w) represents the transfer function of the ear canal and models the echo response. (z(n)=u(n)+y(n)+v(n), where u(n) is the spoken voice 607, y(n) is the echo 609, and v(n) is background noise (if present, for instance due to improper sealing).)

During operation, the echo suppressor 610 monitors the mixed signal 323 delivered to the ECR 125 and produces an echo estimate $\tilde{\gamma}(n)$ of an echo y(n) 609 based on the captured electronic internal signal 410 and the mixed signal 323. The echo suppressor 610, upon learning the ECTF by an adaptive process, can then suppress the echo y(n) 609 of the acoustic audio content 603 (e.g., output mixed signal 323) in the electronic internal signal z(n) 410. It subtracts the echo estimate Y(n) from the electronic internal signal 410 to produce the modified electronic internal signal e(n) 412.

The voice decision logic 620 analyzes the modified electronic signal 412 e(n) and the electronic ambient signal 426 to produce a voice activity level 622, a. The voice activity level a identifies a probability that the user is speaking, for example, when the user is using the earpiece for two way voice communication. The voice activity level 622 can also indicate a degree of voicing (e.g., periodicity, amplitude), When the user is speaking, voice is captured externally (such as from acoustic ambient signal 424) by the ASM 111 in the ambient environment and also by the ECM 123 in the ear canal. The voice decision logic provides the voice activity level a to the acoustic management module 201 as an input parameter for mixing the ASM 111 and ECM 123 signals. Briefly referring back to FIG. 4, the acoustic management module 201 performs the mixing as a function of the voice activity level a and the background noise level (see G=f(BNL)+f(VAL)).

For instance, at low background noise levels and low voice activity levels, the acoustic management module 201 amplifies the electronic ambient signal 426 from the ASM 111 relative to the electronic internal signal 410 from the ECM 123 in producing the mixed signal 323. At medium background noise levels and medium voice activity levels, the acoustic management module 201 attenuates low frequencies in the electronic ambient signal 426 and attenuates high frequencies in the electronic internal signal 410. At high background noise levels and high voice activity levels, the acoustic management module 201 amplifies the electronic internal signal 410 from the ECM 123 relative to the electronic ambient signal 426 from the ASM 111 in producing the mixed signal. The acoustic management module 201 can additionally apply frequency specific filters based on the characteristics of the background noise.

Figure 7:
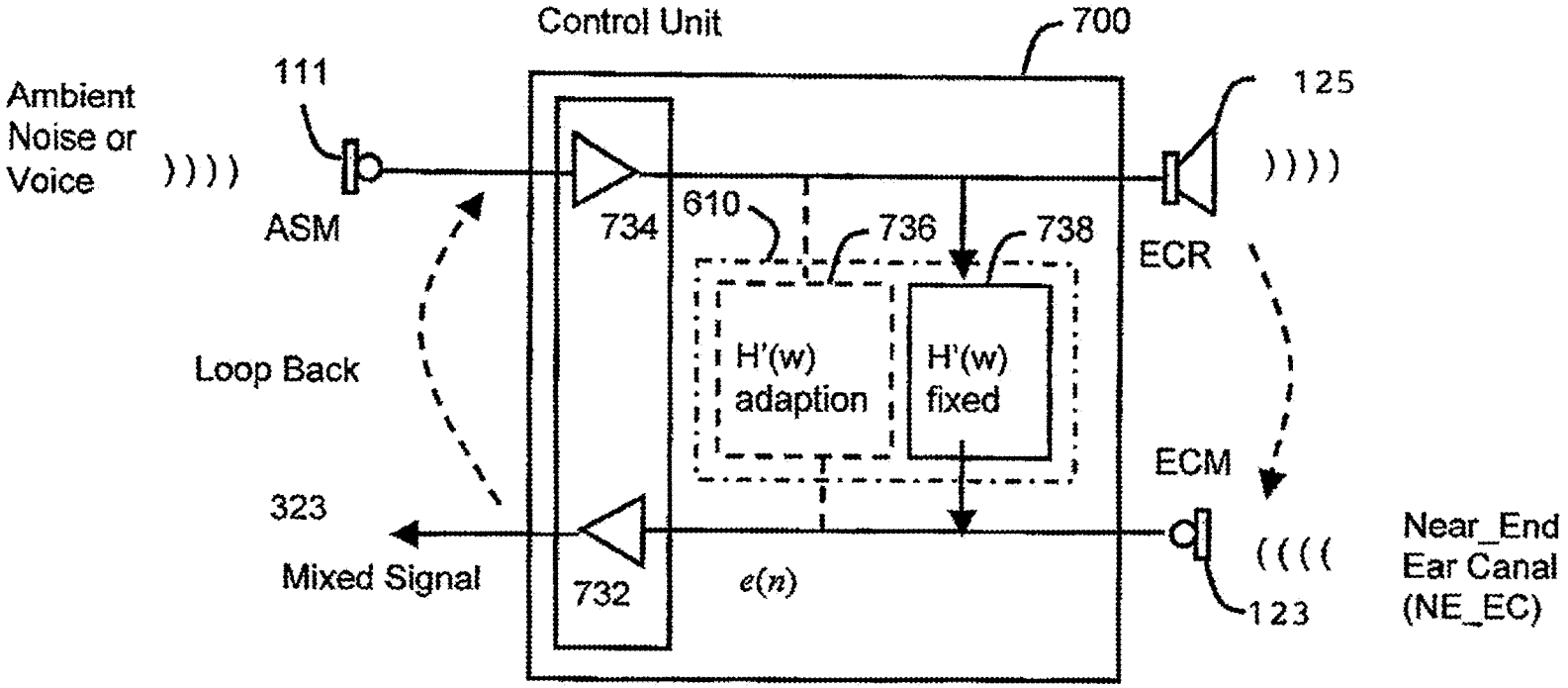
FIG. 7 is a schematic of a control unit for controlling adaptation of a first set and second set of filter coefficients of an echo suppressor for in-ear canal echo suppression in accordance with an exemplary embodiment.

FIG. 7 is a schematic of a control unit 700 for controlling adaptation of a first set (736) and a second set (738) of filter coefficients of the echo suppressor 610 for in-ear canal echo suppression in accordance with an exemplary embodiment. Briefly, the control unit 700 illustrates a freezing (fixing) of weights upon detection of spoken voice. The echo suppressor resumes weight adaptation when e(n) is low, and freezes weights when e(n) is high signifying a presence of spoken voice.

When the user is not speaking, the ECR 125 can pass through ambient sound captured at the ASM 111, thereby allowing the user to hear environmental ambient sounds. As previously discussed, the echo suppressor 610 models an ECTF and suppresses an echo of the mixed signal 323 that is looped back to the ECR 125 by way of the ASM 111 (see dotted line Loop Back path). When the user is not speaking, the echo suppressor continually adapts to model the ECTF. When the ECTF is properly modeled, the echo suppressor 610 produces a modified internal electronic signal e(n) that is low in amplitude level (i.e., low in error). The echo suppressor adapts the weights to keep the error signal low. When the user speaks, the echo suppressor however initially produces a high-level e(n) (e.g., the error signal increases). This happens since the speaker's voice is uncorrelated with the audio signal played out the ECR 125, which disrupts the echo suppressor's ECTF modeling ability.

The control unit 700 upon detecting a rise in e(n), freezes the weights of the echo suppressor 610 to produce a fixed filter H'(w) fixed 738. Upon detecting the rise in e(n) the control unit adjusts the gain 734 for the ASM signal and the gain 732 for the mixed signal 323 that is looped back to the ECR 125. The mixed signal 323 fed back to the ECR 125 permits the user to hear themselves speak. Although the weights are frozen when the user is speaking, a second filter H'(w) 736 continually adapts the weights for generating a second e(n) that is used to determine a presence of spoken voice. That is, the control unit 700 monitors the second error signal e(n) produced by the second filter 736 for monitoring a presence of the spoken voice.

The first error signal e(n) (in a parallel path) generated by the first filter 738 is used as the mixed signal 323. The first error signal contains primarily the spoken voice since the ECTF model has been fixed due to the weights. That is, the second (adaptive) filter is used to monitor a presence of spoken voice, and the first (fixed) filter is used to generate the mixed signal 323.

Upon detecting a fall of e(n), the control unit restores the gains 734 and 732 and unfreezes the weights of the echo suppressor, and the first filter H'(w) returns to being an adaptive filter. The second filter H'(w) 736 remains on stand-by until spoken voice is detected, and at which point, the first filter H'(w) 738 goes fixed, and the second filter H'(w) 736 begins adaptation for producing the e(n) signal that is monitored for voice activity. Notably, the control unit 700 monitors e(n) from the first filter 738 or the second filter 736 for changes in amplitude to determine when spoken voice is detected based on the state of voice activity.

Figure 8:
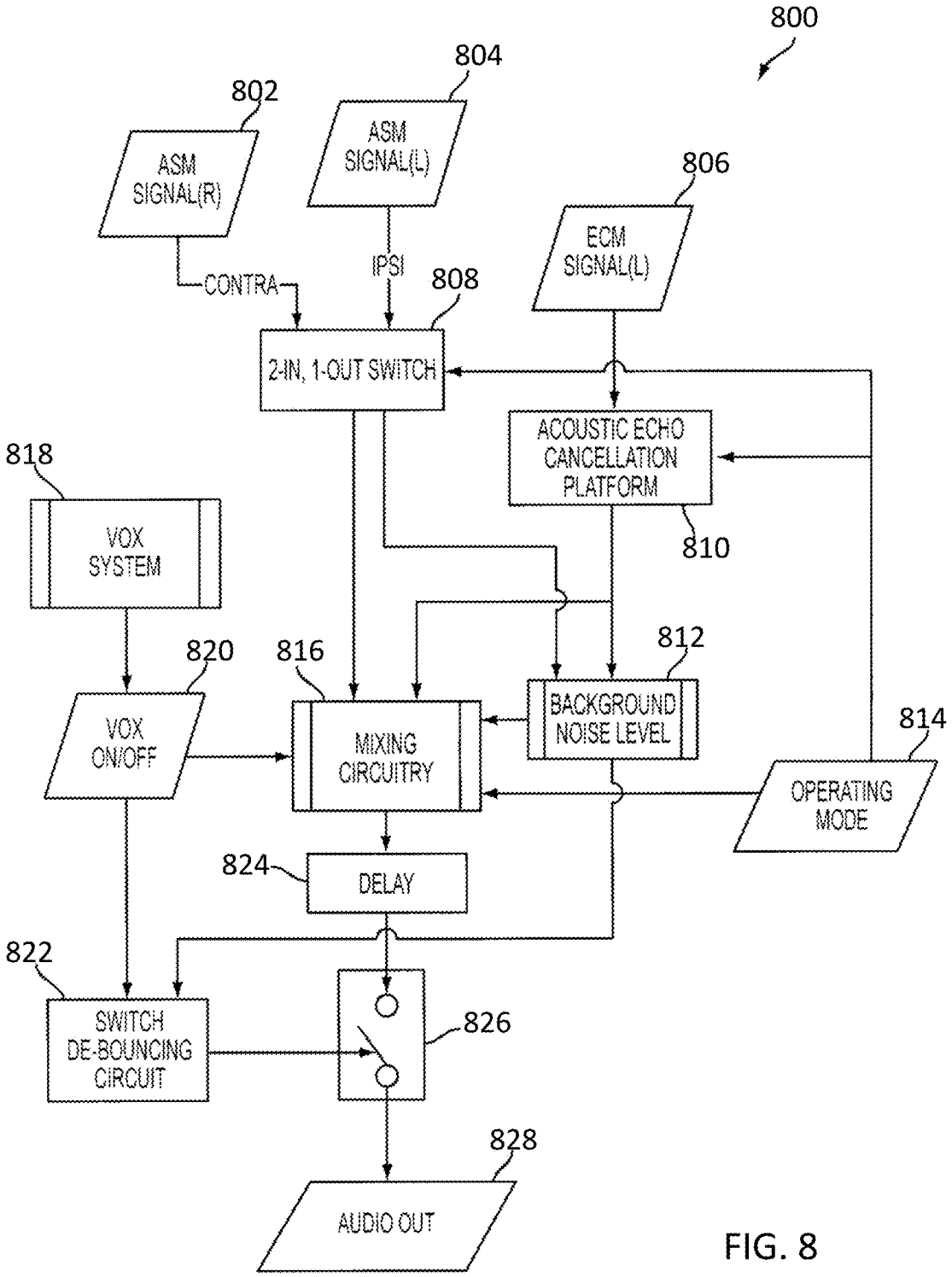
FIG. 8 is a block diagram of a method for an audio mixing system to mix an external microphone signal with an internal microphone signal based on a background noise level and voice activity level in accordance with an exemplary embodiment.

FIG. 8 is a block diagram 800 of a method for an audio mixing system to mix an external microphone signal with an internal microphone signal based on a background noise level and voice activity level in accordance with an exemplary embodiment.

As illustrated the mixing circuitry 816 (shown in center) receives an estimate of the background noise level 812 for mixing either or both the right earpiece ASM signal 802 and the left earpiece ASM signal 804 with the left earpiece ECM signal 806. (The right earpiece ECM signal can be used similarly.) An operating mode selection system 814 selects a switching 808 (e.g., 2-in, 1-out) between the left earpiece ASM signal 804 and the right earpiece ASM signal 802. As indicated earlier, the ASM signals and ECM signals can be first amplified with a gain system and then filtered with a filter system (the filtering may be accomplished using either analog or digital electronics or both). The audio input signals 802, 804, and 806 are therefore taken after this gain and filtering process, if any gain and filtering are used.

The Acoustic Echo Cancellation (AEC) system 810 can be activated with the operating mode selection system 814 when the mixed signal audio output 828 is reproduced with the ECR 125 in the same ear as the ECM 123 signal used to create the mixed signal audio output 828. The acoustic echo cancellation platform 810 can also suppress an echo of a spoken voice generated by the wearer of the earpiece 100. This ensures against acoustic feedback ("howlback").

The Voice Activated System (VOX) 818 in conjunction with a de-bouncing circuit 822 activates the electronic switch 826 to control the mixed signal output 828 from the mixing circuitry 816; the mixed signal is a combination of the left ASM signal 804 or right ASM signal 802, with the left ECM 806 signal. Though not shown, the same arrangement applies for the other earphone device for the right ear, if present. Note that earphones can be used in both ears simultaneously. In a contra-lateral operating mode, as selected by operating mode selection system 814, the ASM and ECM signal are taken from opposite earphone devices, and the mix of these signals is reproduced with the ECR in the earphone that is contra-lateral to the ECM signal, and the same as the ASM signal.

For instance, in the contra-lateral operating mode, the ASM signal from the Right earphone device is mixed with the ECM signal from the left earphone device, and the audio signal corresponding to a mix of these two signals is reproduced with the Ear Canal Receiver (ECR) in the Right earphone device. The mixed signal audio output 828 therefore can contain a mix of the ASM and ECM signals when the user's voice is detected by the VOX. This mixed signal audio output can be used in loopback as a user Self-Monitor System to allow the user to hear their own voice as reproduced with the ECR 125, or it may be transmitted to another voice system, such as a mobile phone, walkie-talkie radio etc. The VOX system 818 that activates the switch 826 may be one a number of VOX embodiments.

Figure 10:
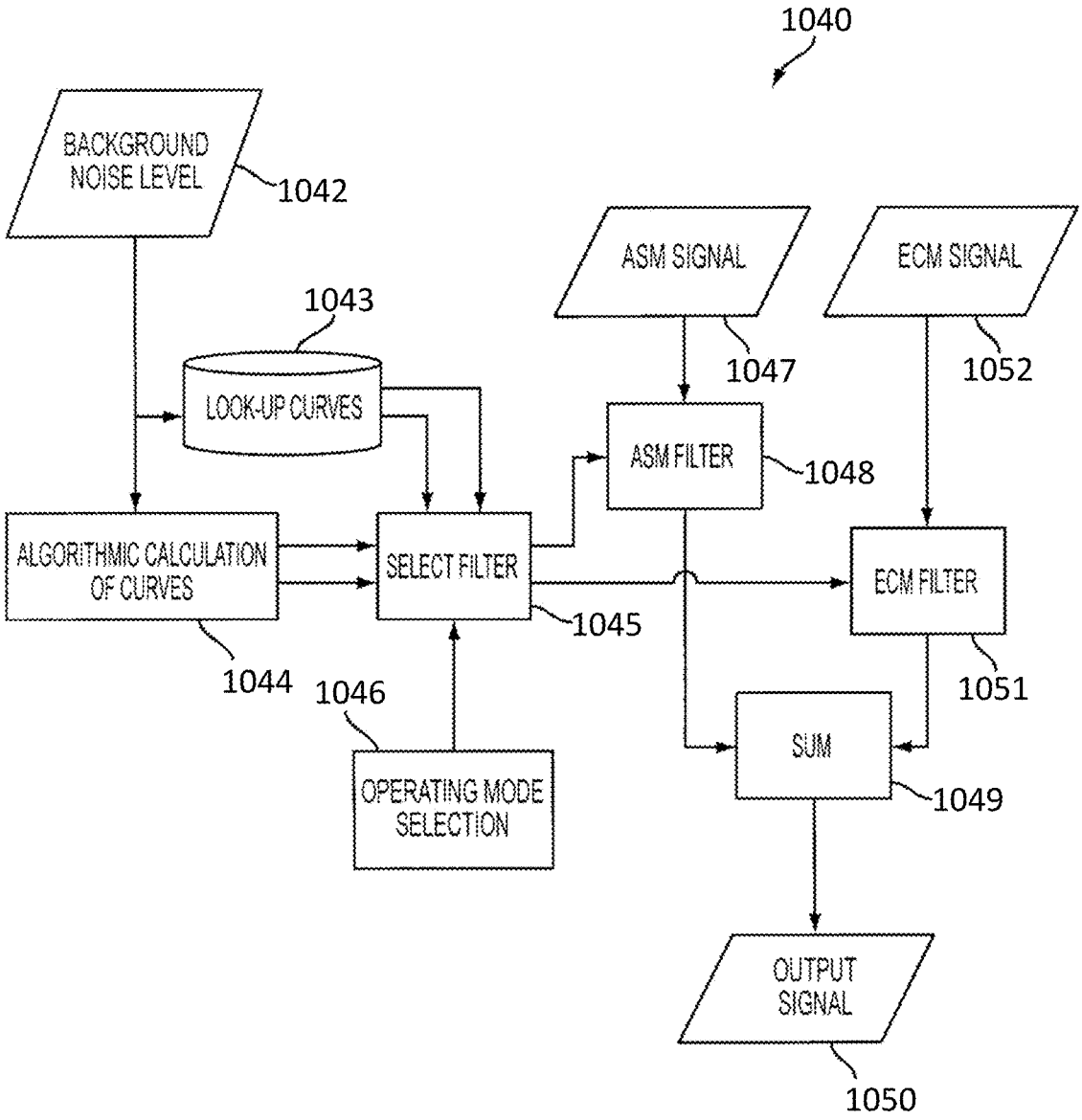
FIG. 10 is a block diagram for mixing an external microphone signal with an internal microphone signal based on a background noise level in accordance with an exemplary embodiment.
Figure 11:
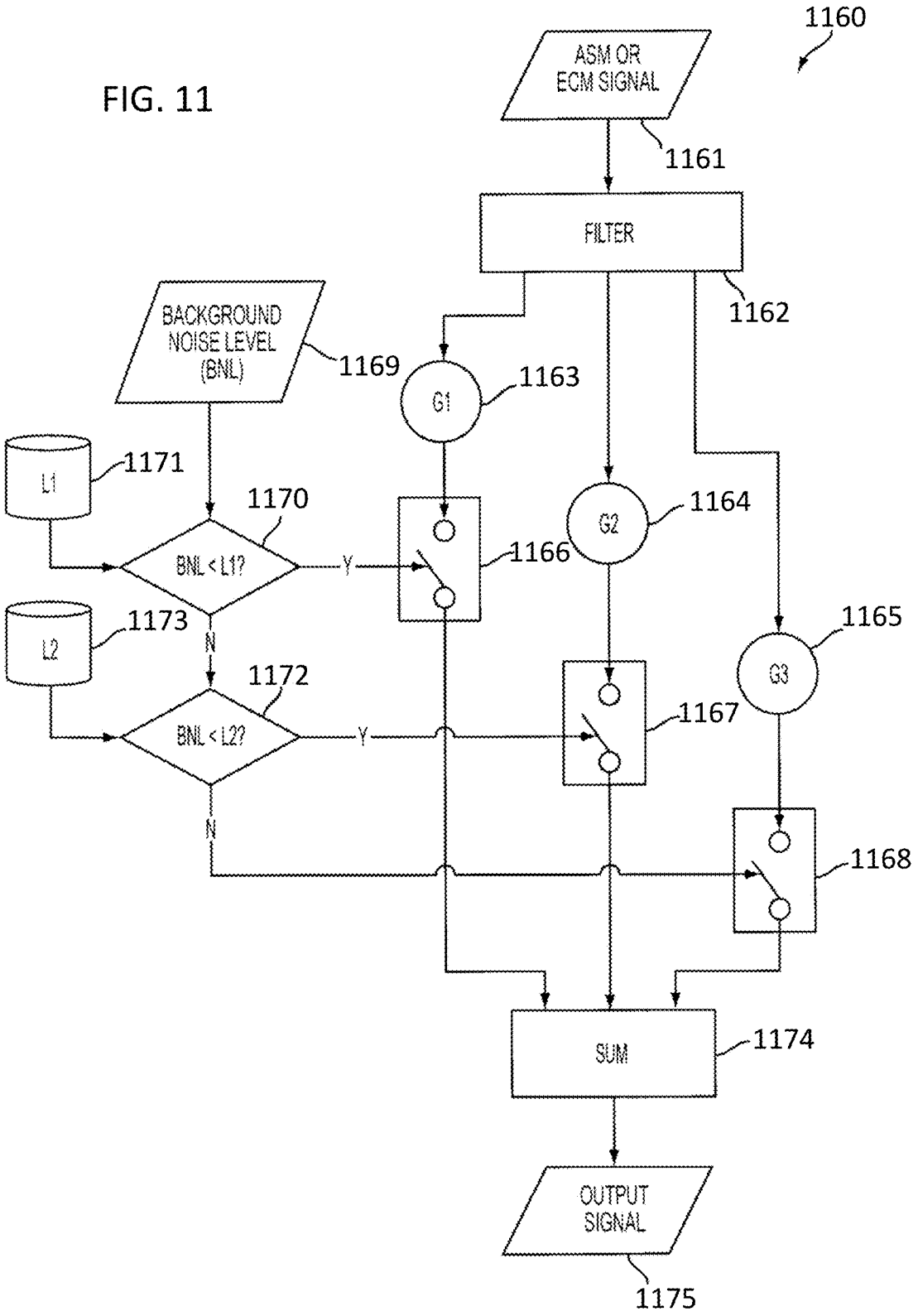
FIG. 11 is a block diagram for an analog circuit for mixing an external microphone signal with an internal microphone signal based on a background noise level in accordance with an exemplary embodiment.

In a particular operating mode, specified by unit 814, the conditioned ASM signal is mixed with the conditioned ECM signal with a ratio dependent on the BNL using audio signal mixing circuitry and the method described in either FIG. 10 or FIG. 11. As the BNL increases, then the ASM signal is mixed with the ECM signal with a decreasing level. When the BNL is above a particular value, then a minimal level of the ASM signal is mixed with the ECM signal. When the VOX switch 618 is active, the mixed ASM and ECM signals are then sent to mixed signal output 828. The switch de-bouncing circuit 826 ensures against the VOX 818 rapidly closing on and off (sometimes called chatter). This can be achieved with a timing circuit using digital or analog electronics. For instance, with a digital system, once the VOX has been activated, a time starts to ensure that the switch 826 is not closed again within a given time period, e.g. 100 ms. The delay unit 824 can improve the sound quality of the mixed signal audio output 828 by compensating for any latency in voice detection by the VOX system 818. In some exemplary embodiments, the switch debouncing circuit 822 can be dependent by the BNL. For instance, when the BNL is high (e.g. above 85 dBA), the de-bouncing circuit can close the switch 826 sooner after the VOX output 818 determines that no user speech (e.g. spoken voice) is present.

Figure 9:
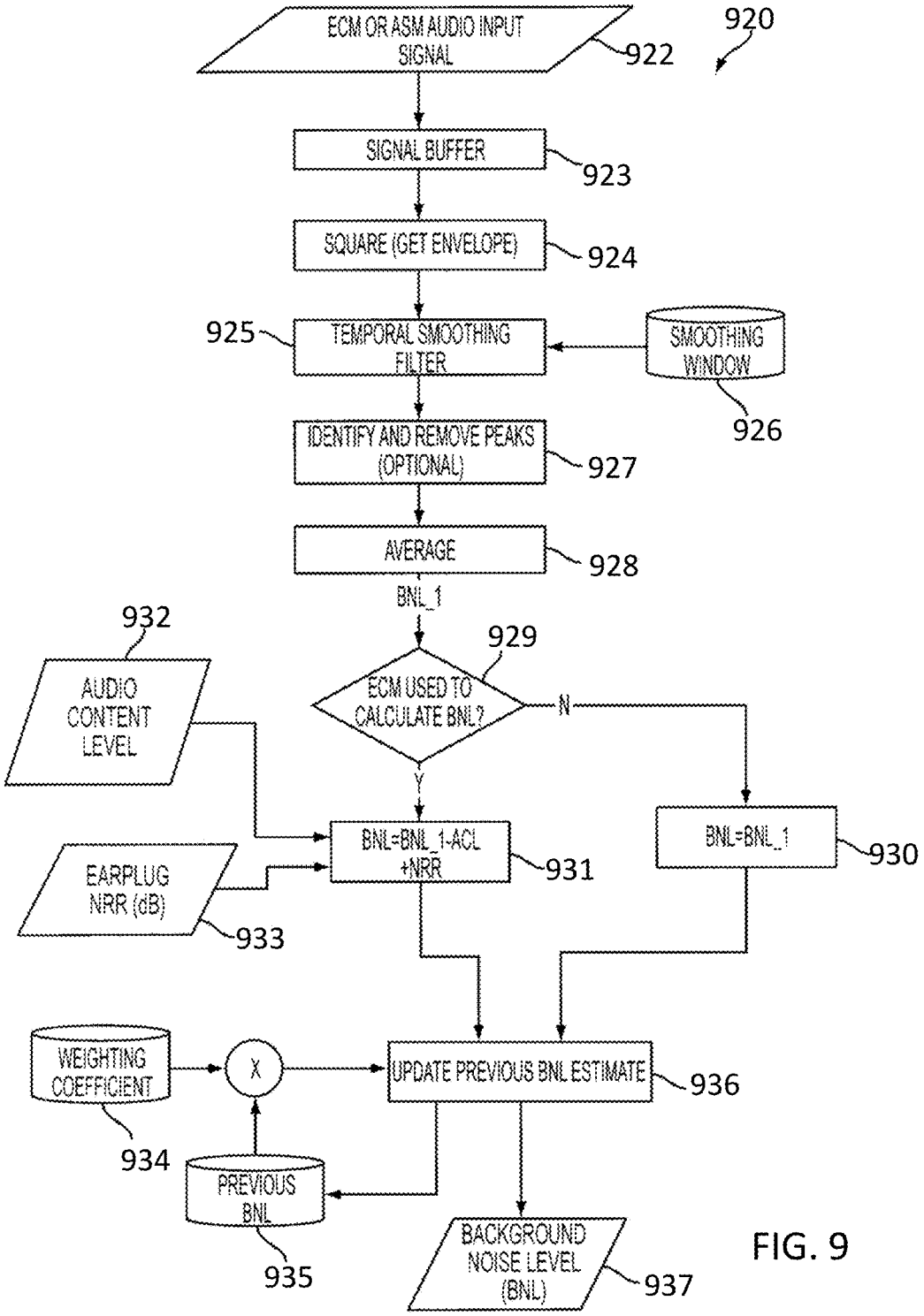
FIG. 9 is a block diagram of a method for calculating background noise levels in accordance with an exemplary embodiment.

FIG. 9 is a block diagram of a method 920 for calculating background noise levels in accordance with an exemplary embodiment. Briefly, the background noise levels can be calculated according to different contexts, for instance, if the user is talking while audio content is playing, if the user is talking while audio content is not playing, if the user is not talking but audio content is playing, and if the user is not talking and no audio content is playing. For instance, the system takes as its inputs either the ECM and/or ASM signal, depending on the particular system configuration. If the ECM signal is used, then the measured BNL accounts for an acoustic attenuation of the earpiece and a level of reproduced audio content.

As illustrated, modules 922-928 provide exemplary steps for calculating a base reference background noise level. The ECM or ASM audio input signal 922 can be buffered 923 in real-time to estimate signal parameters. An envelope detector 924 can estimate a temporal envelope of the ASM or ECM signal. A smoothing filter 925 can minimize abruptions in the temporal envelope. (A smoothing window 926 can be stored in memory). An optional peak detector 927 can remove outlier peaks to further smooth the envelope. An averaging system 928 can then estimate the average background noise level (BNL_1) from the smoothed envelope.

If at step 929, it is determined that the signal from the ECM was used to calculate the BNL_1, an audio content level 932 (ACL) and noise reduction rating 933 (NRR) can be subtracted from the BNL_1 estimate to produce the updated BNL 931. This is done to account for the audio content level reproduced by the ECR 125 that delivers acoustic audio content to the earpiece 100, and to account for an acoustic attenuation level (i.e. Noise Reduction Rating 933) of the earpiece. For example, if the user is listening to music, the acoustic management module 201 takes into account the audio content level delivered to the user when measuring the BNL. If the ECM is not used to calculate the BNL at step 929, the previous real-time frame estimate of the BNL 930 is used.

At step 936, the acoustic management module 201 updates the BNL based on the current measured BNL and previous BNL measurements 935. For instance, the updated BNL 937 can be a weighted estimate 934 of previous BNL estimates according to BNL=2*previous BNL+(1−w)*current BNL, where $0<W<1$. The BNL can be a slow time weighted average of the level of the ASM and/or ECM signals, and may be weighted using a frequency-weighting system, e.g. to give an A-weighted SPL level.

FIG. 10 is a block diagram 1040 for mixing an external microphone signal with an internal microphone signal based on a background noise level to produce a mixed output signal in accordance with an exemplary embodiment. The block diagram can be implemented by the acoustic management module 201 or the processor 121. In particular, FIG. 10 primarily illustrates the selection of microphone filters based on the background noise level. The microphone filters are used to condition the external and internal microphone signals before mixing.

As shown, the filter selection module 1045 can select one or more filters to apply to the microphone signals before mixing. For instance, the filter selection module 1045 can apply an ASM filter 1048 to the ASM signal 1047 and an ECM filter 1051 to the ECM signal 1052 based on the background noise level 1042. The ASM and ECM filters can be retrieved from memory based on the characteristics of the background noise. An operating mode 1046 can determine whether the ASM and ECM filters are look-up curves 1043 from memory or filters whose coefficients are determined in real-time based on the background noise levels.

Prior to mixing with summing unit 1049 to produce output signal 1050, the ASM signal 1047 is filtered with ASM filter 1048, and the ECM signal 1052 is filtered with ECM filter 1051. The filtering can be accomplished by a time-domain transversal filter (FIR-type filter), an IIR-type filter, or with frequency-domain multiplication. The filter can be adaptive (i.e. time variant), and the filter coefficients can be updated on a frame-by-frame basis depending on the BNL. The filter coefficients for a particular BNL can be loaded from computer memory using pre-defined filter curves 1043, or can be calculated using a predefined algorithm 1044, or using a combination of both (e.g. using an interpolation algorithm to create a filter curve for both the ASM filter 1048 and ECM filter 1051 from predefined filters).

FIG. 11 is a block diagram for an analog circuit for mixing an external microphone signal with an internal microphone signal based on a background noise level in accordance with an exemplary embodiment.

In particular, FIG. 11 shows a method 1160 for the filtering of the ECM and ASM signals using analog electronic circuitry prior to mixing. The analog circuit can process both the ECM and ASM signals in parallel; that is, the analog components apply to both the ECM and ASM signals. In one exemplary embodiment, the input audio signal 1161 (e.g., ECM signal, ASM signal) is first filtered with a fixed filter 1162. The filter response of the fixed filter 1162 approximates a low-pass shelf filter when the input signal 1161 is an ECM signal, and approximates a high-pass filter when the input signal 1161 is an ASM signal. In an alternate exemplary embodiment, the filter 1162 is a unity-pass filter (i.e. no spectral attenuation) and the gain units G1, G2 etc instead represent different analog filters. As illustrated, the gains are fixed, though they may be adapted in other embodiments. Depending on the BNL 1169, the filtered signal is then subjected to one of three gains; G1 1163, G2 1164, or G3 1165. (The analog circuit can include more or less than the number of gains shown.)

For low BNLs (e.g. when BNL<L 1170, where L1 is a predetermined level threshold 1171), a G1 is determined for both the ECM signal and the ASM signal. The gain G1 for the ECM signal is approximately zero; i.e. no ECM signal would be present in the output signal 1175. For the ASM input signal, G1 would be approximately unity for low BNL.

For medium BNLs (e.g. when BNL<L2 1172, where L2 is a predetermined level threshold 1173), a G2 is determined for both the ECM signal and the ASM signal. The gain G2 for the ECM signal and the ASM signal is approximately the same. In another embodiment, the gain G2 can be frequency dependent so as to emphasize low frequency content in the ECM and emphasize high frequency content in the ASM signal in the mix. For high BNL; G3 1165 is high for the ECM signal, and low for the ASM signal. The switches 1166, 1167, and 1168 ensure that only one gain channel is applied to the ECM signal and ASM signal. The gain scaled ASM signal and ECM signal are then summed at junction 1174 to produce the mixed output signal 1175.

Figure 12:
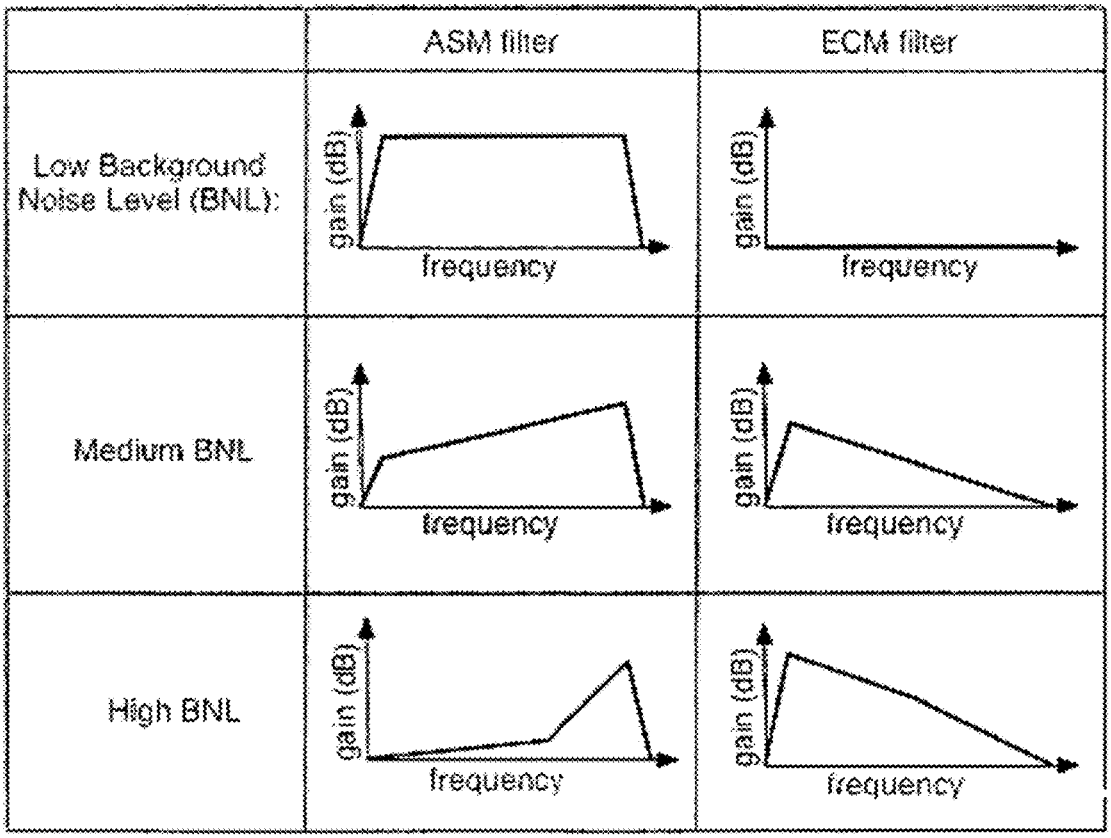
FIG. 12 is a table illustrating exemplary filters suitable for use with an Ambient Sound Microphone (ASM) and Ear Canal Microphone (ECM) based on measured background noise levels (BNL) in accordance with an exemplary embodiment.

Examples of filter response curves for three different BNL are shown in FIG. 12, which is a table illustrating exemplary filters suitable for use with an Ambient Sound Microphone (ASM) and Ear Canal Microphone (ECM) based on measured background noise levels (BNL).

The basic trend for the ASM and ECM filter response at different BNLs is that at low BNLs (e.g. <60 dBA), the ASM signal is primarily used for voice communication. At medium BNL; ASM and ECM are mixed in a ratio depending on the BNL, though the ASM filter can attenuate low frequencies of the ASM signal, and attenuate high frequencies of the ECM signal. At high BNL (e.g. >85 dB), the ASM filter attenuates most al the low frequencies of the ASM signal, and the ECM filter attenuates most all the high frequencies of the ECM signal. In another embodiment of the Acoustic Management System, the ASM and ECM filters may be adjusted by the spectral profile of the background noise measurement. For instance, if there is a large Low Frequency noise in the ambient sound field of the user, then the ASM filter can reduce the low-frequencies of the ASM signal accordingly, and boost the low-frequencies of the ECM signal using the ECM filter.

Where applicable, the present embodiments of the invention can be realized in hardware, software or a combination of hardware and software. Any kind of computer system or other apparatus adapted for carrying out the methods described herein are suitable. A typical combination of hardware and software can be a mobile communications device with a computer program that, when being loaded and executed, can control the mobile communications device such that it carries out the methods described herein. Portions of the present method and system may also be embedded in a computer program product, which comprises all the features enabling the implementation of the methods described herein and which when loaded in a computer system, is able to carry out these methods.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions of the relevant exemplary embodiments. Thus, the description of the invention is merely exemplary in nature and, thus, variations that do not depart from the gist of the invention are intended to be within the scope of the exemplary embodiments of the present invention. Such variations are not to be regarded as a departure from the spirit and scope of the present invention.

We claim:

1. An earphone comprising:

an ambient microphone configured to measure an acoustic environment and generate an ambient signal;

an ear canal microphone configured to generate an internal signal;

a speaker;

a memory that stores an ambient gain and an audio content gain; and a processor, wherein the processor is operatively connected to the microphone, wherein the processor is operatively connected to the speaker, wherein the processor is operatively connected to the memory, wherein the processor receives an audio content, wherein the audio content is at least one of music, a voice signal or a combination thereof;

wherein the processor receives the ambient signal;

wherein the processor receives the internal signal;

wherein the processor detects when a user is speaking by analyzing the difference between the internal signal and the ambient signal;

wherein the processor adjusts the ambient gain if it is detected that the user is speaking;

wherein the processor adjusts the audio content gain if it is detected that the user is speaking;

wherein the processor modifies the ambient signal to generate a modified ambient signal by applying the ambient gain to the ambient signal;

wherein the processor modifies the audio content by applying the audio content gain to the audio content to generate a modified audio content;

wherein the processor mixes the modified ambient signal and the modified audio content to generate a mixed signal; and wherein the processor sends-the mixed signal to the speaker.

2. The earphone according to claim 1, wherein the ambient gain can vary so that the modified ambient signal varies from no ambient passthrough to full ambient passthrough.

3. The earphone according to claim 2, where the ambient gain is set by the user.

4. The earphone according to claim 3, wherein no ambient pass through is equal to an ambient gain of 0.0 and full ambient passthrough is equal to an ambient gain value of 1.0.

5. The earphone according to claim 1, wherein the modified ambient signal is additionally generated by applying a filter to the ambient signal wherein the filter modifies at least one amplitude of at least one frequency of the ambient signal.

6. The earphone according to claim 5, wherein the processor receives a noise reduction signal; and wherein the processor mixes the noise reduction signal with the mixed signal prior to sending the mixed signal to the speaker, wherein the mixed signal includes the modified ambient signal, the modified audio content and the noise reduction signal.

7. The earphone according to claim 6, wherein the noise reduction signal is generated using the ambient signal.

8. The earphone according to claim 6, wherein the noise reduction signal is generated using the internal signal.

9. The earphone according to claim 6, wherein the processor detects when a user is speaking by generating a voice activity level using the ambient signal and the internal signal, then comparing the voice activity level to a threshold.

10. The earphone according to claim 6, wherein the noise reduction signal is generated using both the ambient signal and the internal signal.

11. The earphone according to claim 1, wherein a condition of no audio content passthrough is equal to an audio content gain of 0.0 and a full audio content passthrough is equal to an audio gain value of 1.0.

12. A method comprising:

receiving an audio content, wherein the audio content is at least one of music, a voice signal or a combination thereof;

receiving an ambient signal, wherein the ambient signal is generated by an ambient microphone measuring an ambient acoustic environment;

receiving an internal signal, wherein the internal signal is generated by a microphone measuring a second acoustic environment;

detecting when a user is speaking by analyzing a difference between the internal signal and the ambient signal;

adjusting the ambient gain if it is detected that the user is speaking;

adjusting the audio content gain if it is detected that the user is speaking;

modifying the ambient signal to generate a modified ambient signal by applying the ambient gain to the ambient signal;

modifying the audio content by applying the audio content gain to the audio content to generate a modified audio content;

mixing the modified ambient signal and the modified audio content to generate a mixed signal; and sending the mixed signal to the speaker.

13. The method according to claim 12, wherein the ambient gain can vary so that the modified ambient signal varies from no ambient passthrough to full ambient passthrough.

14. The method according to claim 13, where the ambient gain is set by the user.

15. The method according to claim 14, wherein no ambient passthrough is equal to an ambient gain of 0.0 and full ambient passthrough is equal to an ambient gain value of 1.0.

16. The method according to claim 12, wherein the modified ambient signal is additionally generated by applying a filter to the ambient signal wherein the filter modifies at least one amplitude of at least one frequency of the ambient signal.

17. The method according to claim 12 further comprising:

receiving a noise reduction signal; and mixing the noise reduction signal with the mixed signal prior to sending the mixed signal to the speaker, wherein the mixed signal includes the modified ambient signal, the modified audio content and the noise reduction signal.

* * * * *